US008459067B2

(12) United States Patent
Kendall et al.

(10) Patent No.: US 8,459,067 B2
(45) Date of Patent: Jun. 11, 2013

(54) MODULAR LAUNDRY SYSTEM WITH VERTICAL LAUNDRY MODULE

(75) Inventors: James W. Kendall, Mount Prospect, IL (US); Lorraine L. Achterberg, St. Joseph, MI (US); Ameresh Babu Viswanathan, St. Joseph, MI (US); Colleen M. Doyle, Stevensville, MI (US); Richard A. Sunshine, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 993 days.

(21) Appl. No.: 12/496,849

(22) Filed: Jul. 2, 2009

(65) Prior Publication Data

US 2009/0266118 A1 Oct. 29, 2009

Related U.S. Application Data

(63) Continuation of application No. 11/323,867, filed on Dec. 30, 2005, now abandoned, and a continuation-in-part of application No. 11/323,221, filed on Dec. 30, 2005, now Pat. No. 7,624,600, which is a continuation-in-part of application No. 10/971,671, filed on Oct. 22, 2004, now Pat. No. 7,513,132.

(51) Int. Cl.
*D06F 29/00* (2006.01)
*D06F 39/00* (2006.01)

(52) U.S. Cl.
CPC ..... *D06F 29/00* (2013.01); *D06F 29/005* (2013.01); *D06F 39/00* (2013.01)
USPC ..... 68/13 R

(58) Field of Classification Search
CPC ..... D06F 29/00; D06F 29/005; D06F 39/00; D06F 39/12; D06F 57/12; D06F 95/00
USPC ..... 68/3 R, 13 R, 214, 235 R, 240
See application file for complete search history.

(56) References Cited

U.S. PATENT DOCUMENTS 88,281 A 3/1869 Montigny
315,725 A 4/1885 Caughy (Continued)

FOREIGN PATENT DOCUMENTS

BE 1013066 8/2001
CA 2330236 11/2001

(Continued)

OTHER PUBLICATIONS

NPL: Better Lifestyle Products; Rolling Mobile Laundry Ironing Center; Jul. 28, 2005; http://www.betterlifestyleproducts.com/mobile-laundry-center.html.

(Continued)

*Primary Examiner* — Joseph L Perrin
(74) *Attorney, Agent, or Firm* — Clifton G. Green; McGarry Bair PC

(57) ABSTRACT

A laundry system comprises a first laundry appliance, a second laundry appliance, and a vertical laundry module. The vertical laundry module can have a housing with a width less than the width of each of the first and second laundry appliances. The vertical laundry module can have a drawer that slidably opens from a face of the housing and/or a door that opens from the face of the housing. The vertical laundry module can further have an exterior hanging element.

17 Claims, 16 Drawing Sheets

U.S. PATENT DOCUMENTS

| | | | |
|---|---|---|---|
| 380,949 | A | 4/1888 | Shannon |
| 496,655 | A | 5/1893 | Hilton |
| 502,237 | A | 7/1893 | Proctor |
| 602,494 | A | 4/1898 | Briggs |
| 699,922 | A | 5/1902 | Hyson et al. |
| 707,409 | A | 8/1902 | Guitar |
| 870,805 | A | 11/1907 | Trager |
| 900,347 | A | 10/1908 | Berry |
| 916,849 | A | 3/1909 | Darrow |
| 970,174 | A | 9/1910 | Booton |
| 1,000,933 | A | 8/1911 | North |
| 1,078,882 | A | 11/1913 | Scott |
| 1,203,752 | A | 11/1916 | Le Claire |
| 1,255,399 | A | 2/1918 | Ferren |
| 1,278,072 | A | 9/1918 | Ossry |
| 1,317,829 | A | 10/1919 | Shroyer |
| 1,369,933 | A | 3/1921 | Nelson |
| 1,482,742 | A | 2/1924 | Gilchrist |
| 1,485,991 | A | 3/1924 | Mulley |
| 1,532,973 | A | 4/1925 | Adelson |
| 1,590,390 | A | 6/1926 | Miller |
| 1,665,118 | A | 4/1928 | Thompson et al. |
| 1,691,042 | A | 11/1928 | Bell |
| 1,720,165 | A | 7/1929 | Bloom et al. |
| 1,728,458 | A | 9/1929 | Verduce |
| 1,752,797 | A | 4/1930 | Hutchinson, Jr. |
| 1,767,157 | A | 6/1930 | Steele |
| 1,900,793 | A | 11/1931 | Broughton |
| 1,994,044 | A | 3/1935 | Michelet |
| 2,060,065 | A | 11/1936 | Gill et al. |
| 2,102,449 | A | 12/1937 | Zimmerman |
| 2,140,961 | A | 12/1938 | Lendle |
| 2,287,646 | A | 12/1938 | Steele |
| D113,031 | S | 1/1939 | Baer et al. |
| 2,202,811 | A | 6/1940 | Carney et al. |
| 2,230,793 | A | 2/1941 | Borah |
| 2,256,425 | A | 9/1941 | Damiano |
| 2,279,984 | A | 4/1942 | Goodwin |
| 2,284,572 | A | 5/1942 | Holder |
| D132,963 | S | 7/1942 | Salomon |
| 2,295,378 | A | 9/1942 | Barnsteiner |
| 2,295,718 | A | 9/1942 | Dahlberg |
| 2,312,220 | A | 2/1943 | Snyder |
| 2,326,062 | A | 8/1943 | Parker |
| 2,339,495 | A | 1/1944 | McMann |
| 2,346,133 | A | 4/1944 | Hayes |
| 2,355,835 | A | 8/1944 | Whalen |
| 2,369,366 | A | 2/1945 | O'Neill |
| 2,402,477 | A | 6/1946 | Williams |
| 2,412,270 | A | 12/1946 | Johnston |
| 2,419,319 | A | 4/1947 | Lankton |
| 2,422,825 | A | 6/1947 | Davis, Jr. |
| 2,434,404 | A | 1/1948 | Goodwin |
| 2,434,886 | A | 1/1948 | Pugh |
| 2,624,137 | A | 1/1948 | Gysin |
| 2,435,439 | A | 2/1948 | Goodwin et al. |
| 2,447,480 | A | 8/1948 | Stubbs |
| 2,463,218 | A | 3/1949 | Travis |
| 2,475,106 | A | 7/1949 | Mohr et al. |
| 2,478,531 | A | 8/1949 | Harris et al. |
| 2,482,412 | A | 9/1949 | Gershon |
| 2,486,058 | A | 10/1949 | Patterson et al. |
| 2,499,078 | A | 2/1950 | Shaw |
| 2,641,072 | A | 2/1950 | Maher |
| 2,499,455 | A | 3/1950 | Brochu |
| 2,526,030 | A | 10/1950 | Kagan |
| 2,543,579 | A | 2/1951 | Kauffmann, II |
| 2,547,238 | A | 4/1951 | Tremblay |
| 2,547,382 | A | 4/1951 | Freeman |
| 2,548,437 | A | 4/1951 | Mantagas |
| 2,556,943 | A | 6/1951 | Reisman |
| 2,566,488 | A | 9/1951 | Gould |
| 2,570,529 | A | 10/1951 | Dolan |
| 2,576,067 | A | 11/1951 | Chandler |
| 2,587,111 | A | 2/1952 | Cashen, Jr. |
| 2,602,315 | A | 7/1952 | Shoop et al. |
| 2,637,192 | A | 5/1953 | Richterkessing |
| 2,645,863 | A | 7/1953 | Morrison |
| 2,650,442 | A | 9/1953 | Johnson |
| D170,556 | S | 10/1953 | Sterling |
| 2,654,386 | A | 10/1953 | Wotring |
| 2,657,566 | A | 11/1953 | Richterkessing |
| 2,664,646 | A | 1/1954 | Bourner |
| 2,665,183 | A | 1/1954 | Battles |
| 2,668,091 | A | 2/1954 | Clark |
| 2,687,566 | A | 8/1954 | Hall |
| 2,707,837 | A | 5/1955 | Robinson et al. |
| 2,707,874 | A | 5/1955 | Glover, Jr. |
| 2,719,422 | A | 10/1955 | Golden |
| 2,728,481 | A | 12/1955 | Robinson et al. |
| 2,731,316 | A | 1/1956 | Cohen |
| 2,732,700 | A | 1/1956 | Dunn |
| 2,737,573 | A | 3/1956 | Olthuis |
| 2,742,708 | A | 4/1956 | McCormick |
| 2,742,710 | A | 4/1956 | Richterkessing |
| 2,758,387 | A | 8/1956 | Stann |
| 2,759,277 | A | 8/1956 | Malnick |
| 2,813,534 | A | 11/1956 | Low |
| 2,773,373 | A | 12/1956 | Corson |
| 2,919,340 | A | 12/1956 | Jacobs |
| D179,475 | S | 1/1957 | Emile et al. |
| 2,778,705 | A | 1/1957 | Barker |
| 2,786,730 | A | 3/1957 | Thurston |
| 2,787,849 | A | 4/1957 | Lacey |
| 2,903,711 | A | 4/1957 | Kesling |
| 2,799,948 | A | 7/1957 | Morrison |
| 2,807,503 | A | 9/1957 | Buterbaugh |
| 2,813,353 | A | 11/1957 | McMillan |
| 2,817,157 | A | 12/1957 | McCormick |
| 2,817,501 | A | 12/1957 | Schubert |
| 2,843,945 | A | 7/1958 | Whyte |
| 2,861,355 | A | 11/1958 | Douglas |
| 3,001,844 | A | 5/1959 | Spring |
| 2,893,807 | A | 7/1959 | Earle |
| 2,895,618 | A | 7/1959 | Nathan |
| 2,895,782 | A | 7/1959 | Fragale |
| 2,933,360 | A | 4/1960 | Sitler |
| 2,960,780 | A | 11/1960 | Stilwell, Jr. |
| 2,967,670 | A | 1/1961 | McRoberts |
| 2,979,932 | A | 4/1961 | Hughes |
| 2,983,050 | A | 5/1961 | Alaback |
| 2,985,967 | A | 5/1961 | Pataillot et al. |
| 3,000,108 | A | 9/1961 | Jones et al. |
| 3,022,589 | A | 2/1962 | Kleinman |
| 3,026,699 | A | 3/1962 | Rhodes |
| 3,030,792 | A | 4/1962 | Bader |
| 3,031,871 | A | 5/1962 | Bailey |
| 3,059,632 | A | 10/1962 | Rogers |
| 3,059,653 | A | 10/1962 | Ingolia |
| 3,245,161 | A | 10/1962 | Adiletta et al. |
| 3,061,942 | A | 11/1962 | Scofield |
| 3,086,657 | A | 4/1963 | Myers et al. |
| D195,518 | S | 6/1963 | Bullock et al. |
| 3,170,417 | A | 12/1963 | Avidiya |
| 3,173,730 | A | 3/1965 | Collins |
| 3,344,532 | A | 6/1965 | Bigler |
| 3,197,886 | A | 8/1965 | Brame et al. |
| 3,209,560 | A | 10/1965 | Shelton |
| 3,220,230 | A | 11/1965 | Jacobs et al. |
| 3,220,790 | A | 11/1965 | White |
| 3,230,961 | A | 1/1966 | Benkert et al. |
| 3,256,616 | A | 6/1966 | McGoldrick |
| 3,316,659 | A | 5/1967 | Lauck |
| 3,320,780 | A | 5/1967 | Frahm |
| 3,331,226 | A | 7/1967 | Fink |
| 3,356,841 | A | 12/1967 | Horan |
| 3,506,321 | A | 5/1968 | Hampel |
| 3,399,783 | A | 9/1968 | Injeski |
| 3,402,477 | A | 9/1968 | Hubbard |
| 3,406,645 | A | 10/1968 | Monroe |
| 3,417,481 | A | 12/1968 | Rumsey, Jr. |
| 3,418,665 | A | 12/1968 | Long |
| 3,427,831 | A | 2/1969 | Frauendorf |
| 3,432,939 | A | 3/1969 | Eichholz |
| 3,606,506 | A | 3/1969 | Ungaro |
| 3,563,624 | A | 7/1969 | Stice |
| 3,469,603 | A | 9/1969 | Nagel |

3,490,254 A 1/1970 Mason
3,500,666 A 3/1970 Calcaterra
3,512,379 A 5/1970 Buckley et al.
3,513,786 A 5/1970 Kellogg
3,522,817 A 8/1970 Raymond
3,527,352 A 9/1970 Lapa
3,537,110 A 11/1970 Horie
3,550,284 A 12/1970 Lambert
3,555,701 A 1/1971 Hubbard
3,559,427 A 2/1971 Baker
3,579,851 A 5/1971 Elmy
3,619,830 A 11/1971 Harris et al.
3,670,425 A 6/1972 Benjamin et al.
3,688,706 A 9/1972 Merryweather
3,717,173 A 2/1973 Nyberg et al.
3,724,095 A 4/1973 Laue et al.
3,739,496 A 6/1973 Buckley et al.
3,743,372 A 7/1973 Ruggerone
3,744,402 A 7/1973 Piegza et al.
3,744,435 A 7/1973 Tracy et al.
3,745,676 A 7/1973 Dikoff
3,764,793 A 10/1973 Binzer
3,774,742 A 11/1973 Magnanelli
3,793,744 A 2/1974 Saita
3,811,198 A 5/1974 Baltes
3,840,998 A 10/1974 Marcussen
3,866,336 A 2/1975 Bereza
3,926,315 A 12/1975 Bernard
3,958,586 A 5/1976 Schnelle
3,981,404 A 9/1976 Goeke
3,983,583 A 10/1976 Herman et al.
4,002,383 A 1/1977 Holloway, Jr.
4,086,709 A 5/1978 Jackson
4,091,155 A 5/1978 Behr
4,094,414 A 6/1978 Thiot et al.
4,109,397 A 8/1978 Daily
4,120,180 A 10/1978 Jedora
D251,165 S 2/1979 Moody
4,171,545 A 10/1979 Kann
4,180,919 A 1/1980 Baltes
4,221,441 A 9/1980 Bain
4,243,197 A 1/1981 Wright
D258,293 S 2/1981 Macowski
4,254,873 A 3/1981 Cook, III et al.
4,262,605 A 4/1981 Sokol
4,510,778 A 4/1985 Cotton
4,557,058 A 12/1985 Ozawa et al.
D283,474 S 4/1986 Appel
4,602,446 A 7/1986 Guion
4,617,743 A 10/1986 Barnard
4,621,003 A 11/1986 O'Kane
D286,958 S 12/1986 Gualtieri
4,625,432 A 12/1986 Baltes
4,637,321 A 1/1987 Hasler et al.
4,653,200 A 3/1987 Werner
4,663,538 A 5/1987 Cotton et al.
4,682,424 A 7/1987 Irving
4,713,949 A 12/1987 Wilcox
4,723,583 A 2/1988 Lowe et al.
4,734,826 A 3/1988 Wilson et al.
4,760,929 A 8/1988 Fedorchak
4,799,743 A 1/1989 Kikuchi et al.
4,819,341 A 4/1989 Gayso
4,856,206 A 8/1989 Klein
4,857,703 A 8/1989 Wilkins
4,863,222 A 9/1989 Posso
4,894,935 A 1/1990 Kretz
D306,240 S 2/1990 Newhouse
4,901,871 A 2/1990 Ohm et al.
4,908,957 A 3/1990 Acosta, Sr. et al.
4,919,368 A 4/1990 Garrett
4,926,514 A 5/1990 Leuenberger
4,980,981 A * 1/1991 Naidoo ..... 38/1 C
4,995,681 A 2/1991 Parnell
D315,068 S 3/1991 Miller
5,018,628 A 5/1991 Schenck et al.
5,019,126 A 5/1991 Post
5,046,844 A 9/1991 Milton
5,058,403 A 10/1991 Barnes
5,062,219 A 11/1991 Harris et al.
5,121,698 A 6/1992 Kelley
D328,171 S 7/1992 Hikawa
5,136,792 A 8/1992 Janecke
5,147,090 A 9/1992 Mandell et al.
5,152,077 A 10/1992 Liang
D331,257 S 11/1992 Breen et al.
5,165,181 A 11/1992 Acosta, Sr. et al.
5,181,685 A 1/1993 Ostapowicz
5,203,044 A 4/1993 Jung, Jr.
D336,706 S 6/1993 Lechman et al.
5,241,766 A 9/1993 Walz et al.
5,253,378 A 10/1993 Jung, Jr.
5,253,493 A 10/1993 Ohashi
5,253,932 A 10/1993 Nesovic
5,279,047 A 1/1994 Janecke
5,290,998 A 3/1994 Couch et al.
5,294,009 A 3/1994 Maurer et al.
5,301,376 A 4/1994 Herbert
5,305,484 A 4/1994 Fitzpatrick et al.
5,315,726 A 5/1994 Borenstein
5,315,773 A 5/1994 Iwami et al.
5,331,945 A 7/1994 Somerton
5,337,905 A 8/1994 Gast
D350,646 S 9/1994 Bescher et al.
5,369,892 A 12/1994 Dhaemers
5,381,574 A 1/1995 VonPless
5,402,657 A 4/1995 Henry, Jr.
5,411,164 A 5/1995 Smith et al.
5,452,531 A 9/1995 Graville et al.
5,461,887 A 10/1995 VonPless
5,466,058 A 11/1995 Chan
D365,224 S 12/1995 Pohlman
5,486,041 A 1/1996 Sykes
5,518,309 A 5/1996 St-Pierre
5,528,912 A 6/1996 Weber
5,546,678 A 8/1996 Dhaemers
5,555,640 A 9/1996 Ou
D374,954 S 10/1996 Katz et al.
5,568,691 A 10/1996 Rubin
5,570,598 A 11/1996 Haven
5,595,427 A 1/1997 Peters et al.
5,609,047 A 3/1997 Hellman, Jr. et al.
5,653,221 A 8/1997 Luken et al.
5,664,339 A 9/1997 Swanson et al.
5,666,743 A 9/1997 Dawson
5,702,010 A 12/1997 Liang
5,706,678 A 1/1998 Sasaki
5,733,022 A 3/1998 Whetstone
5,743,025 A 4/1998 Jordan, Jr.
5,755,040 A 5/1998 Ou
D395,639 S 6/1998 Ham et al.
5,778,573 A 7/1998 Nottingham et al.
5,787,615 A 8/1998 Hensel et al.
D398,906 S 9/1998 Fynn et al.
5,806,207 A 9/1998 Merrigan
5,815,961 A 10/1998 Estes et al.
5,836,486 A 11/1998 Ohsugi
D401,782 S 12/1998 Mitchell
5,848,828 A 12/1998 MacLellan
5,858,521 A 1/1999 Okuda et al.
5,900,258 A 5/1999 Engler
D410,351 S 6/1999 Magnusson et al.
5,951,127 A 9/1999 Smith
5,957,557 A 9/1999 Langer et al.
5,967,342 A 10/1999 Steffine
5,974,980 A 11/1999 Kent
5,983,808 A 11/1999 Weil
5,987,773 A 11/1999 Lipscy
D417,701 S 12/1999 Jack
5,996,983 A 12/1999 Laurenzi
6,000,158 A 12/1999 Zoellner
6,016,610 A 1/2000 Sears
6,036,150 A 3/2000 Lehrman
6,082,841 A 7/2000 Smith et al.
6,101,741 A 8/2000 Sears
D431,130 S 9/2000 Thompson et al.
D431,934 S 10/2000 Chininis
6,131,929 A 10/2000 Haley

| | | | |
|---|---|---|---|
| 6,134,806 | A | 10/2000 | Dhaemers |
| 6,135,583 | A | 10/2000 | Simon et al. |
| 6,138,979 | A | 10/2000 | Morman |
| D433,248 | S | 11/2000 | Hellwig et al. |
| 6,151,795 | A | 11/2000 | Hoffman et al. |
| D435,741 | S | 1/2001 | Schlereth |
| D436,952 | S | 1/2001 | Goto |
| D438,047 | S | 2/2001 | Chavez |
| 6,189,346 | B1 | 2/2001 | Chen et al. |
| 6,219,876 | B1 | 4/2001 | Blum |
| 6,253,472 | B1 | 7/2001 | Gast |
| 6,263,591 | B1 | 7/2001 | La Porte |
| 6,263,708 | B1 | 7/2001 | Yarmosky |
| 6,263,869 | B1 | 7/2001 | Abernethy |
| 6,267,462 | B1 | 7/2001 | Krause et al. |
| D446,891 | S | 8/2001 | Kim |
| 6,279,876 | B1 | 8/2001 | Massie |
| 6,311,945 | B1 | 11/2001 | D'Angelo |
| 6,334,340 | B1 | 1/2002 | Kegler et al. |
| 6,352,038 | B1 | 3/2002 | Nelson et al. |
| 6,353,954 | B1 | 3/2002 | Dunsbergen et al. |
| 6,374,644 | B1 | 4/2002 | Rhode et al. |
| 6,375,686 | B1 | 4/2002 | Kim |
| D457,749 | S | 5/2002 | Doane |
| D457,991 | S | 5/2002 | Baldwin et al. |
| D457,992 | S | 5/2002 | Baldwin et al. |
| 6,384,380 | B1 * | 5/2002 | Faries et al. ..... 219/385 |
| 6,386,378 | B1 | 5/2002 | Scharing |
| 6,397,502 | B1 | 6/2002 | Chen |
| D459,844 | S | 7/2002 | Baldwin et al. |
| 6,427,259 | B1 | 8/2002 | Cawthon |
| D463,631 | S | 9/2002 | Baldwin et al. |
| 6,448,306 | B1 | 9/2002 | Lever et al. |
| D465,308 | S | 11/2002 | Resuello et al. |
| 6,475,594 | B2 | 11/2002 | Johnston et al. |
| 6,482,242 | B2 | 11/2002 | Yarmosky |
| 6,484,645 | B2 | 11/2002 | Allen |
| 6,502,570 | B2 | 1/2003 | Grady |
| 6,510,280 | B1 | 1/2003 | Chen |
| D474,566 | S | 5/2003 | Baldwin et al. |
| 6,572,208 | B2 | 6/2003 | Albaizar et al. |
| 6,585,225 | B1 | 7/2003 | Lake |
| 6,588,238 | B1 | 7/2003 | Reason |
| 6,604,473 | B2 | 8/2003 | Felsenthal |
| 6,611,972 | B2 | 9/2003 | Underbrink et al. |
| 6,618,887 | B2 | 9/2003 | Kim et al. |
| D489,496 | S | 5/2004 | Sneddon |
| 6,732,552 | B2 | 5/2004 | Kim et al. |
| D492,073 | S | 6/2004 | Sneddon |
| 6,745,496 | B2 | 6/2004 | Cassella |
| D492,507 | S | 7/2004 | Moon et al. |
| D495,453 | S | 8/2004 | Baldwin et al. |
| 6,793,991 | B2 | 9/2004 | Thuma et al. |
| 6,796,055 | B2 | 9/2004 | Baltes |
| D497,162 | S | 10/2004 | Neal et al. |
| 6,845,569 | B1 | 1/2005 | Kim |
| 6,846,871 | B2 | 1/2005 | Patel et al. |
| D501,615 | S | 2/2005 | Chen |
| D502,577 | S | 3/2005 | Baldwin et al. |
| 6,860,032 | B2 | 3/2005 | Meyer |
| 6,866,336 | B2 | 3/2005 | De Gaillard |
| 6,868,621 | B1 | 3/2005 | Grimm et al. |
| D504,038 | S | 4/2005 | Perella et al. |
| 6,883,257 | B2 | 4/2005 | Couch et al. |
| 6,886,371 | B2 | 5/2005 | Arai et al. |
| 6,886,373 | B2 | 5/2005 | Carrubba et al. |
| 6,889,399 | B2 | 5/2005 | Steiner et al. |
| 6,889,449 | B2 | 5/2005 | Silver |
| D506,090 | S | 6/2005 | Ben-Or |
| 6,910,292 | B2 | 6/2005 | Prows |
| D508,346 | S | 8/2005 | Petruccelli |
| D519,692 | S | 4/2006 | Jun |
| 7,036,243 | B2 | 5/2006 | Doh et al. |
| 7,062,871 | B1 | 6/2006 | Smidt |
| 7,065,904 | B2 | 6/2006 | Lee et al. |
| D524,079 | S | 7/2006 | Grosfillex |
| D526,453 | S | 8/2006 | Jun |
| 7,100,316 | B2 | 9/2006 | Obileye |
| D532,455 | S | 11/2006 | Beardslee |
| D534,215 | S | 12/2006 | Nakata |
| 7,171,761 | B1 | 2/2007 | Hunts |
| 7,191,546 | B2 | 3/2007 | Maruca |
| 7,207,197 | B2 | 4/2007 | North |
| D541,563 | S | 5/2007 | LaBonia, Jr. et al. |
| 7,213,792 | B2 | 5/2007 | Choi |
| 7,251,905 | B2 | 8/2007 | Doh et al. |
| 7,313,932 | B2 | 1/2008 | Ryohke et al. |
| 2002/0017117 | A1 | 2/2002 | Sunshine et al. |
| 2002/0043604 | A1 | 4/2002 | Cooper et al. |
| 2002/0056163 | A1 | 5/2002 | Estes et al. |
| 2002/0137631 | A1 | 9/2002 | Falder et al. |
| 2003/0019798 | A1 | 1/2003 | Capps et al. |
| 2003/0062810 | A1 | 4/2003 | Westwinkel |
| 2003/0074105 | A1 | 4/2003 | Capps et al. |
| 2003/0196460 | A1 | 10/2003 | Lyu et al. |
| 2003/0222085 | A1 | 12/2003 | Kaczmarek |
| 2004/0022405 | A1 | 2/2004 | Caron et al. |
| 2004/0034924 | A1 | 2/2004 | Underbrink et al. |
| 2004/0040084 | A1 | 3/2004 | Underbrink et al. |
| 2004/0040476 | A1 | 3/2004 | Diers |
| 2004/0134087 | A1 * | 7/2004 | Meyer ..... 34/90 |
| 2004/0134237 | A1 | 7/2004 | Sunshine et al. |
| 2004/0139555 | A1 | 7/2004 | Conrad et al. |
| 2004/0144140 | A1 | 7/2004 | Lee |
| 2004/0154194 | A1 | 8/2004 | Prows |
| 2004/0160150 | A1 | 8/2004 | Hay et al. |
| 2004/0181979 | A1 | 9/2004 | Compeau et al. |
| 2004/0182288 | A1 | 9/2004 | Goldberg et al. |
| 2004/0194339 | A1 | 10/2004 | Johnson et al. |
| 2004/0221411 | A1 | 11/2004 | Blum et al. |
| 2004/0221624 | A1 | 11/2004 | Fumagalli |
| 2004/0226320 | A1 | 11/2004 | Bongini |
| 2004/0245899 | A1 | 12/2004 | Cho |
| 2004/0263032 | A1 | 12/2004 | Cho |
| 2005/0017605 | A1 | 1/2005 | Bauer |
| 2005/0035076 | A1 | 2/2005 | Schober et al. |
| 2005/0040070 | A1 | 2/2005 | Adams |
| 2005/0040184 | A1 | 2/2005 | Noyes et al. |
| 2005/0056059 | A1 | 3/2005 | Usherovich et al. |
| 2005/0072194 | A1 | 4/2005 | Ryohke et al. |
| 2005/0120585 | A1 | 6/2005 | Lee et al. |
| 2005/0120757 | A1 | 6/2005 | Jackson |
| 2005/0126035 | A1 | 6/2005 | Lee et al. |
| 2005/0132593 | A1 | 6/2005 | Doh et al. |
| 2005/0132594 | A1 | 6/2005 | Doh et al. |
| 2005/0132604 | A1 | 6/2005 | Hong et al. |
| 2005/0155393 | A1 | 7/2005 | Wright et al. |
| 2005/0275325 | A1 | 12/2005 | Yang |
| 2005/0284867 | A1 | 12/2005 | Sander et al. |
| 2007/0028479 | A1 | 2/2007 | Hunts |
| 2007/0051864 | A1 | 3/2007 | Bartell et al. |
| 2007/0113419 | A1 | 5/2007 | Belgard |
| 2009/0126421 | A1 | 5/2009 | Kim et al. |

FOREIGN PATENT DOCUMENTS

| | | | |
|---|---|---|---|
| DE | 662984 | | 7/1938 |
| DE | 945683 | | 7/1956 |
| DE | 2402065 | | 7/1975 |
| DE | 8033429 | | 5/1982 |
| DE | 3131532 | A1 | 3/1983 |
| DE | 3211316 | | 9/1983 |
| DE | 3213420 | | 10/1983 |
| DE | 3409972 | | 9/1985 |
| DE | 3417481 | | 11/1985 |
| DE | 3904423 | | 8/1990 |
| DE | 9104422 | | 7/1991 |
| DE | 4105112 | | 8/1992 |
| DE | 4228469 | | 5/1993 |
| DE | 9419048 | | 3/1995 |
| DE | 4343488 | A1 | 6/1995 |
| DE | 19514821 | | 11/1995 |
| DE | 29606946 | | 8/1996 |
| DE | 19604370 | | 6/1997 |
| DE | 29704672 | | 7/1997 |
| DE | 19716825 | | 4/1998 |
| DE | 19750946 | | 10/1998 |
| DE | 19832675 | | 1/2000 |
| DE | 19838630 | | 3/2000 |

| | | |
|---|---|---|
| DE | 19922647 | 11/2000 |
| DE | 20101254 | 4/2001 |
| DE | 10055918 | 5/2002 |
| DE | 20302572 | 4/2003 |
| DE | 10223539 | 12/2003 |
| EP | 0050395 | 4/1982 |
| EP | 0265704 | 5/1988 |
| EP | 355701 | 2/1990 |
| EP | 0449060 | 10/1991 |
| EP | 1146161 | 10/2001 |
| EP | 1205129 | 5/2002 |
| EP | 1227182 | 7/2002 |
| EP | 1288367 | 3/2003 |
| EP | 1371307 | 12/2003 |
| EP | 1431442 | 6/2004 |
| EP | 1444922 | 8/2004 |
| EP | 1467015 | 10/2004 |
| EP | 1495697 | 1/2005 |
| EP | 1731654 | 12/2006 |
| FR | 1116286 | 5/1956 |
| FR | 2510881 | 2/1983 |
| FR | 2595937 | 9/1987 |
| FR | 2604196 | 3/1988 |
| FR | 2626016 | 7/1989 |
| FR | 2646674 | 11/1990 |
| FR | 2760761 | 9/1998 |
| GB | 326511 | 3/1930 |
| GB | 336679 | 10/1930 |
| GB | 384352 | 12/1932 |
| GB | 442615 | 2/1936 |
| GB | 582959 | 12/1946 |
| GB | 617965 | 2/1949 |
| GB | 618803 | 2/1949 |
| GB | 855965 | 12/1960 |
| GB | 1355656 | 6/1974 |
| GB | 1399827 | 7/1975 |
| GB | 2164552 | 3/1986 |
| GB | 2221970 | 2/1990 |
| GB | 2271360 A | 4/1994 |
| GB | 2297982 | 8/1996 |
| GB | 2407860 | 5/2005 |
| JP | 64009000 | 1/1989 |
| JP | 01223998 | 9/1989 |
| JP | 02307414 | 12/1990 |
| JP | 03012196 | 1/1991 |
| JP | 03275099 | 12/1991 |
| JP | 426455 | 1/1992 |
| JP | 04187194 | 7/1992 |
| JP | 04220210 | 8/1992 |
| JP | 04220211 | 8/1992 |
| JP | 04220212 | 8/1992 |
| JP | 04220213 | 8/1992 |
| JP | 04220214 | 8/1992 |
| JP | 04237000 | 8/1992 |
| JP | 05277298 | 10/1993 |
| JP | 671100 | 3/1994 |
| JP | 06343794 | 12/1994 |
| JP | 07116395 | 5/1995 |
| JP | 07194661 | 8/1995 |
| JP | 07213792 | 8/1995 |
| JP | 07227495 | 8/1995 |
| JP | 08047599 | 2/1996 |
| JP | 8191998 | 7/1996 |
| JP | 8192000 | 7/1996 |
| JP | 08299070 | 11/1996 |
| JP | 09010492 | 1/1997 |
| JP | 09149826 | 6/1997 |
| JP | 10057699 | 3/1998 |
| JP | 11146995 | 6/1999 |
| JP | 2000218093 | 8/2000 |
| JP | 2000218095 | 8/2000 |
| JP | 2000225299 | 8/2000 |
| JP | 2001157800 | 6/2001 |
| JP | 2002000997 | 1/2002 |
| JP | 2002126395 | 5/2002 |
| JP | 2002136799 | 5/2002 |
| JP | 2002233693 | 8/2002 |
| JP | 2002322702 | 11/2002 |
| JP | 2003019382 | 1/2003 |
| JP | 2003114611 | 4/2003 |
| JP | 2003311097 | 11/2003 |
| KR | 200201898 | 11/2000 |
| KR | 1020040009401 | 1/2004 |
| WO | 8803579 | 5/1988 |
| WO | 9317601 | 9/1993 |
| WO | 9627309 | 9/1996 |
| WO | 9629458 | 9/1996 |
| WO | 9829595 | 7/1998 |
| WO | 0026463 | 5/2000 |
| WO | 03035961 | 5/2003 |
| WO | 2004063452 | 7/2004 |
| WO | 2004099308 | 11/2004 |
| WO | 2004109021 | 12/2004 |
| WO | 2004110214 | 12/2004 |
| WO | 2005001191 | 1/2005 |
| WO | 2005045121 | 5/2005 |
| WO | 2006073885 | 7/2006 |

OTHER PUBLICATIONS

NPL: Bosch; Bosch Laundry Vertical Stacking Kit with Pull-Out Tray; Jul. 26, 2006; http://www.bosch appliances.com/customer_care/1492_423.asp.

NPL: Thor Appliance Company; Washing Machine—APEX by Thor; Jul. 26, 2005 http://thorappliances.com/ apex/index.php, http://thorappliances.com/apex/images/apexzoom2.jpg,http://thorappliances.com/apex/apexAnatomy.php.

* cited by examiner

MODULAR LAUNDRY SYSTEM WITH VERTICAL LAUNDRY MODULE

CROSS-REFERENCE TO RELATED APPLICATIONS

This application is a continuation of U.S. patent application Ser. No. 11/323,867, filed Dec. 30, 2005, now abandoned, and a continuation-in-part of U.S. patent application Ser. No. 11/323,221, filed Dec. 30, 2005, now U.S. Pat. No. 7,624,600, issued Dec. 1, 2009, which is a continuation-in-part of U.S. patent application Ser. No. 10/971,671, filed Oct. 22, 2004, now U.S. Pat. No. 7,513,132, issued Apr. 7, 2009, all of which are incorporated herein by reference in their entirety.

BACKGROUND OF THE INVENTION

1. Field of the Invention

The present invention relates generally to a vertical laundry module for use with a laundry system.

2. Description of the Related Art

Laundry appliances, such as washing machines and clothes dryers, for cleaning fabric items are commonly housed in one area of a home, such as a dedicated laundry room. Basic laundry care and cleaning of fabric items requires washing and drying fabric items. Additional laundry care can require several steps, including hand-washing, flat-drying, ironing, and stain treatment. After fabric items have been cleaned, fabric items must be folded or hung.

Each of these laundry care steps can require one or more laundry aids and equipment beyond a washing machine and clothes dryer. A laundry aid is a substance or agent used to clean or care for fabric items, such as, but not limited to, a laundry detergent, fabric softener, dryer sheets, bleach, spray-dewrinkler, or other substance used for cleaning fabric items. Additional equipment required for laundry care can include items such as an iron, ironing board, hangers and hanging rods for hanging fabric items, and mesh-screens for flat-drying.

Many of the steps in the laundry process are spread throughout the home. To clean fabric items, dirty fabric items are typically brought to the laundry room from other rooms in the home. Sorting fabric items into separate loads is also often done in other rooms. The storing and sorting of fabric items outside the laundry room is necessary because many laundry rooms do not have the necessary space.

Fabric items that must be hand-washed, are usually washed in a room other than the laundry room as some laundry rooms are not equipped with a sink. The hand washing in a room other than the laundry room scatters the laundry care throughout the home.

After washing a load of fabric items, a user most often transfers the damp fabric items to the clothes dryer to dry the fabric items. After fabric items are removed from the clothes dryer, the user often goes to another room to fold and hang fabric items.

Additional care of fabric items such as ironing, flat-drying and stain treatment is often done away from the laundry room. Again, many laundry rooms have space restrictions that prohibit the user from setting up an ironing board and ironing fabric items within the laundry room. Special fabric items, such as delicates and sweaters, are often flat-dried instead of being dried in the clothes dryer, thus also requiring extra space not found in many laundry rooms. Stain treatment often requires water and, as discussed above, many laundry rooms are not equipped with a sink. As with hand-washing, the user must treat the fabric item in another room of the home that is equipped with a sink.

Laundry aids and equipment used during each of the above-mentioned steps are stored when not in use, and it is advantageous to the user to store these items near the location where they are used. Some users use separate storage means such as shelving systems, cabinets, or cupboards that are added to a laundry room to the often limited area not already utilized by the washing machine or clothes dryer. These separate storage means can lend a haphazard appearance the laundry room, especially when compared to a matched-set washing machine and clothes dryer.

The decentralization of the laundry process throughout various rooms in the home increases the difficulty of the laundry process, along with increasing the inconvenience to the consumer.

SUMMARY OF THE INVENTION

A modular laundry system comprising a first laundry appliance, a second laundry appliance, and a vertical laundry module. The vertical laundry module comprises a housing defining an interior and having an upper surface and a width less than the width of each of the first and second laundry appliances. The vertical laundry module can have a drawer that slidably opens from a face of the housing and/or a door that opens from the face of the housing, and at least one hanging element located exteriorly of the housing. The first laundry appliance, the second laundry appliance, and the vertical laundry module are stand-alone units arranged in a contiguous relationship to form a coherent modular system.

DESCRIPTION OF EMBODIMENTS OF THE INVENTION

Figure 1A:
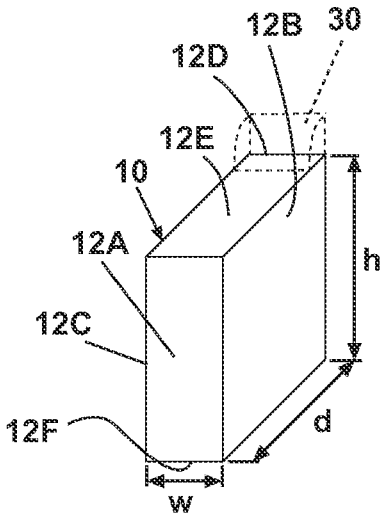
FIG. 1*a* is a schematic illustration of a vertical laundry module according to the present invention.
Figure 1B:
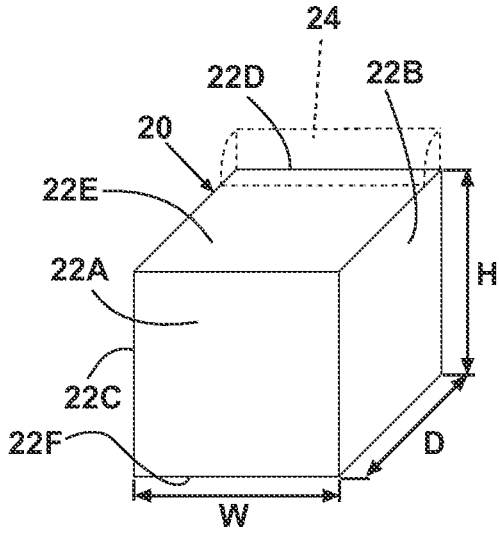
FIG. 1*b* is a schematic illustration of a laundry appliance.

A vertical laundry module 10 according to the invention is used in conjunction with at least one laundry appliance 20. Referring to FIGS. 1*a*-1*b*, the vertical laundry module 10 and laundry appliance 20 are illustrated schematically to show their basic configurations. The laundry appliance 20 is a conventional appliance for washing and drying fabric items, such as clothes and linens. Examples of the laundry appliance include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, and a non-aqueous washing apparatus. An exemplary non-aqueous washing apparatus is disclosed in U.S. Patent Application Publication No. 2005/0155393, which is incorporated herein by reference in its entirety. The non-aqueous washing apparatus of the incorporated application publication comprises a wash unit and a reclamation unit, and the laundry appliance 20 can be the wash unit.

Referring to FIG. 1*b*, the laundry appliance 20 comprises a front face 22*a*, a right side face 22*b*, a left side face 22*c*, a rear face 22*d*, a top face 22*e*, and a bottom face 22*f* joined together to form a box-like structure with a height H, width W, and depth D. The laundry appliance 20 can further comprise a backsplash 24 extending above the top face 22*e* such that the rear lower edge of the backsplash is aligned with the edge of the laundry appliance formed by the rear face 22*d* and top face 22*e* and extends laterally from the right side face 22*b* to the left side face 22*c*. In other words, the width of the backsplash 24 is generally equal to the width W of the laundry appliance 20. The backsplash 24 is commonly used to house the control panel of the laundry appliance 20. As defined for purposes of this application, the height H of the laundry appliance 20 does not include the height of the backsplash 24. In FIG. 1*b*, the laundry appliance 20 is depicted as a cube; however, the width W, the height H, and the depth D need not be equal. The laundry appliances 20 that are presently commercially available have a range of dimensions, and it is within the scope of the invention to utilize a laundry appliance having any suitable dimensions. Exemplary dimensions for the laundry appliance 20 are 27"W×38"H×31.5"D. A survey of multiple commercially available washing machines and dryers resulted in the following exemplary dimensions, which are given in inches and rounded to the nearest whole number:

| DIMENSION | AVERAGE | MAXIMUM | MINIMUM |
|---|---|---|---|
| Washing machine W | 24 | 27 | 20 |
| Washign machine H | 35 | 39 | 26 |
| Washing machine D | 25 | 34 | 20 |
| Dryer W | 27 | 29 | 23 |
| Dryer H | 36 | 38 | 31 |
| Dryer D | 28 | 32 | 21 |

Referring to FIG. 1*a*, the vertical laundry module 10 is a stand-alone unit comprising a front face 12*a*, a right side face 12*b*, a left side face 12*c*, a rear face 12*d*, a top face 12*e*, and a bottom face 12*f* joined together to form a cabinet with a height h, width w, and depth d. The descriptor 'vertical' is used for the vertical laundry module 10 to illustrate that the height h of the vertical laundry module 10 is generally greater than the width w. The height h and depth d of the vertical laundry module 10 can be generally equal, or one dimension can be greater than the other. Exemplary heights h for the vertical laundry module 10 are about 34.7", 37" and 34.7". Exemplary widths w for the vertical laundry module 10 are about 10.5", 13.5", and 15.5". An exemplary depth d for the vertical laundry module 10 is about 25.5".

The vertical laundry module 10 and the laundry appliance 20 each have an effective upper surface, where the effective upper surface is defined as the upper surface of the vertical laundry module 10 and the laundry appliance 20 that is substantially located at their respective heights h, H. In most cases, the effective upper surface will be the top faces 12*e*, 22*e*, although there are some exceptions for the vertical laundry module 10, as will be described below.

Figure 2A:
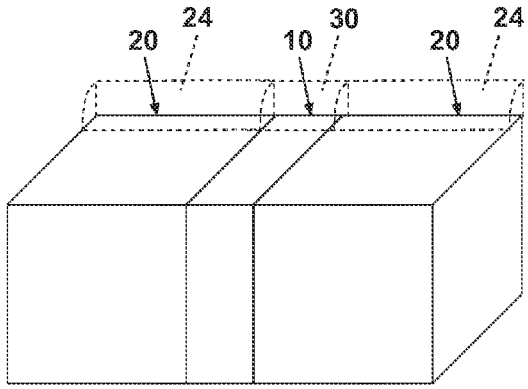
FIG. 2*a* is a schematic illustration of the vertical laundry module positioned between two laundry appliances.
Figure 2B:
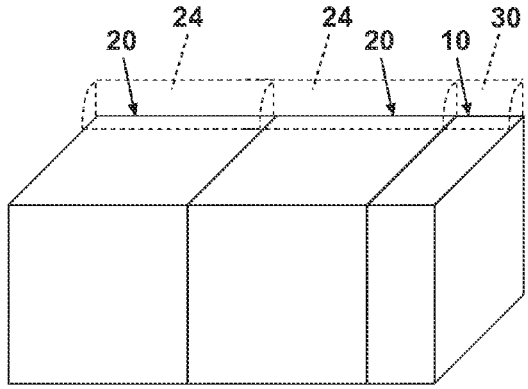
FIG. 2*b* is a schematic illustration of the vertical laundry module positioned next to two laundry appliances.

According to one aspect of the invention, a laundry system comprises at least one vertical laundry module 10 and at least one laundry appliance 20, and the effective upper surface of the vertical laundry module 10 is located at substantially the same height as the effective upper surface of the laundry appliance 20. The vertical laundry module 10 can be positioned adjacent to two laundry appliances 20, as shown in FIG. 2*a*, where the vertical laundry module 10 is, for example, positioned between a washing machine and a clothes dryer, or can be positioned adjacent to one laundry appliance 20, as shown in FIG. 2*b*, where the vertical laundry module 10 is, for example, positioned next to a clothes dryer that is next to a washing machine. As illustrated, the effective upper surface of the vertical laundry module 10 is located at substantially the same height as the effective upper surface of the laundry appliance 20. In other words, the height h of the vertical laundry module 10 is approximately equal to the height H of the laundry appliance 20. However, the height h and depth d of the vertical laundry module 10 can vary relative to the height H and depth D of the associated laundry appliance 20. As illustrated, the width w of the vertical laundry module 10 is less than the width W of the laundry appliance 20, however, the width w of the vertical laundry appliance 10 can vary depending on factors such as the amount of space available for the vertical laundry module 10 or a desired function of the vertical laundry module 10, as will be discussed in more detail below.

Figure 2C:
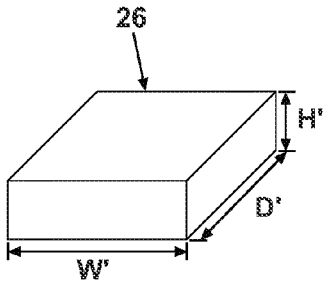
FIG. 2*c* is a schematic illustration of a horizontal module.

Referring to FIG. 2*c*, the vertical laundry module 10 and/or the laundry appliance 20 can be stacked with a horizontal module 26 having a height H', depth D' and width W' where an upper surface of the horizontal module is substantially located at the height H'. The horizontal module 26 can be a pedestal where the laundry appliance 20 rests on the pedestal, such as is disclosed in U.S. Patent Application Publication No. 2004/0245899, published Dec. 9, 2004, which is incorporated herein by reference in its entirety. When the vertical laundry module 10 is stacked with the horizontal module 26, the effective upper surface of the vertical laundry module 10 is the higher of the upper surface of the vertical laundry module 10 and the upper surface of the horizontal module 26. For example, in the case where the horizontal module 26 is stacked on top of the vertical laundry module, the effective upper surface of the vertical laundry module 10 is the upper surface of the horizontal module 26. In the case where the vertical laundry module 10 is stacked on the horizontal module 26 comprising a pedestal, the effective upper surface of the vertical laundry module 10 is the upper surface of the vertical laundry module 10. The same process applies for determining the effective upper surface of the laundry appliance 20 stacked with the horizontal module 26.

Figure 2D:
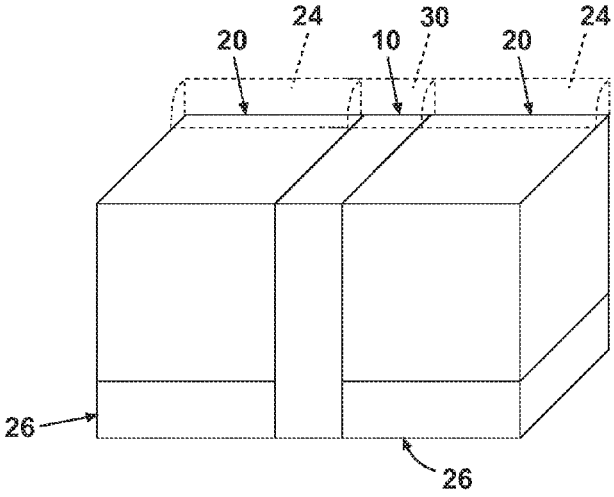
FIG. 2*d* is a schematic illustration of the vertical laundry module positioned between two laundry appliances resting on horizontal modules.
Figure 2E:
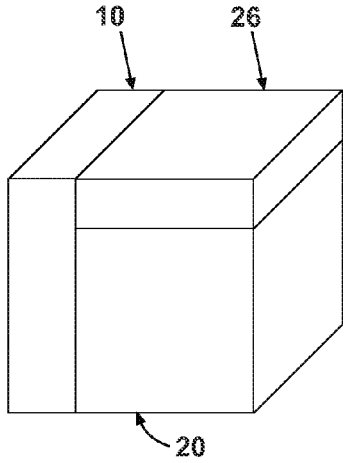
FIG. 2*e* is a schematic illustration of the vertical laundry module positioned next to a stacked laundry appliance and horizontal module.
Figure 2F:
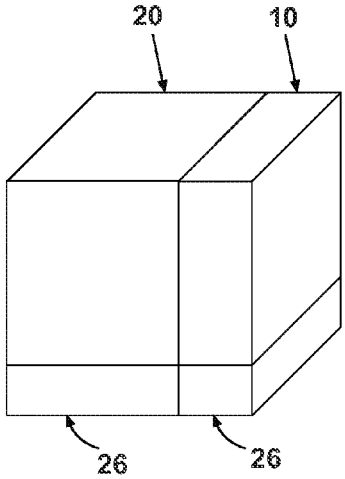
FIG. 2*f* is a schematic illustration of the vertical laundry module positioned next to a laundry appliance where both are stacked with horizontal modules.

Referring to FIG. 2*d*, the vertical laundry module 10 can be positioned adjacent two laundry appliances 20 that are stacked on top of horizontal modules 26 comprising pedestals. The depth D' and width W' of the horizontal modules 26 can be approximately equal to the depth D and width W of the laundry appliances 20. In this case, the effective upper surfaces of the laundry appliances 20 are the upper surfaces of the laundry appliances 20 such that the upper surfaces of the laundry appliance 20 are located at substantially the same height as the effective upper surface of the vertical laundry module 10. Referring to FIG. 2*e*, the vertical laundry module 10 can be positioned next to one laundry appliance 20 having a horizontal module 26 stacked on top of the laundry appliance 20. The depth D' and width W' of the horizontal modules 26 can be approximately equal to the depth D and width W of the laundry appliances 20. In this case, the effective upper surface of laundry appliance 20 is the upper surface of the horizontal module 26 such that the upper surface of the horizontal module 26 is located at substantially the same height as the effective upper surface of the vertical laundry module 10. Referring to FIG. 2*f*, the vertical laundry module 10 is positioned next to one laundry appliance 20, and both are stacked on top of the horizontal modules 26 comprising pedestals. In this case, the effective upper surfaces of the vertical laundry module 10 and the laundry appliance 20 are the upper surfaces of the vertical laundry module 10 and the laundry appliance 20, respectively, such that the upper surfaces of the vertical laundry module 10 and the laundry appliance 20 are located at substantially the same height.

Other configurations of laundry systems are disclosed in application Ser. No. 11/323,125, now U.S. Pat. No. 7,628,043, titled "Modular Laundry System with Horizontal Modules," application Ser. No. 11/322,715, now abandoned, titled "Modular Laundry System with Horizontal Module Spanning Two Laundry Appliances," application Ser. No. 11/323,221, now U.S. Pat. No. 7,624,600, titled "Modular Laundry System with Horizontally Arranged Cabinet Module," application Ser. No. 11/322,739, now abandoned, titled "Modular Laundry System with Horizontal and Vertical Modules," application Ser. No. 11/323,075, now abandoned, titled "Modular Laundry System with Vertical Module," application Ser. No. 11/323,147, now U.S. Pat. No. 7,617,702, titled "Modular Laundry System with Cabinet Module," application Ser. No. 11/322,742, now abandoned, titled "Laundry Module for Modular Laundry System," application Ser. No. 11/323,220, now abandoned, titled "Modular Laundry System with Work Surface," application Ser. No. 11/322,773, now abandoned, titled "Modular Laundry System with Segmented Work Surface," application Ser. No. 11/322,741, now abandoned, titled "Modular Laundry System with Work Surface Having a Functional Insert," and application Ser. No. 11/322,740, now abandoned, titled "Modular Laundry System with Work Surface Having a Functional Element," all of which were filed Dec. 30, 2005 and are incorporated herein by reference in their entirety. The laundry system can also comprise additional vertical and/or horizontal laundry modules, and examples of suitable vertical and horizontal laundry modules are disclosed in application Ser. No. 11/322,943, now U.S. Pat. No. 7,562,543, titled "Vertical Laundry Module with Backsplash," and application Ser. No. 11/322,502, now U.S. Pat. No. 7,913,419, titled "Non-Tumble Clothes Dryer," both of which were filed Dec. 30, 2005 and are incorporated herein by reference in their entirety.

As shown in FIG. 1*a*, the vertical laundry module 10 can comprise a backsplash 30 that can extend above the top face 12*e* such that the rear lower edge of the backsplash is aligned with the edge of the vertical laundry module 10 formed by the rear face 12*d* and top face 12*e* and laterally from the right side face 12*b* to the left side face 12*c*. In other words, the width of the backsplash 30 is generally equal to the width w of the vertical laundry module 10. As defined for purposes of this invention, the height h of the vertical laundry module 10 does not include the height of the backsplash 30.

The backsplash 30 is formed to complement the backsplash 24 of the laundry appliance 20 such that the backsplash 30 aesthetically matches the backsplash 24. Since the widths of the backsplashes 30, 24 are determined by the widths of the respective vertical laundry module 10 and laundry appliance 20, and the width w of the laundry module 10 is generally less that the width W of the laundry appliance 20, the width of the backsplash 30 is generally less that the width of the backsplash 24. Thus the backsplash 30 is not required to have the same dimensions the backsplash 24. However, the backsplash 30 has a profile that physically matches a profile of the backsplash 24. For example, the vertical laundry module backsplash 30 can have the same height, depth, proportion, style, and/or color as the backsplash 24 on the laundry appliance 20. The backsplash 30 also functions to prevent items from falling behind the vertical laundry module 10. The backsplash 30 can also comprise a functional element as will be described in detail below.

The vertical laundry module 10 can comprise a drawer or a door that allows a user to access the interior space of the vertical module 10. The drawer can be mounted in the vertical laundry module 10 to slidably open through the front face 12*a* to reveal an interior storage space. The width and depth of the drawer are such that the drawer can fit within the vertical laundry module 10. The height of the drawer can vary, from being substantially equal to the height of the vertical laundry module 10 so that the vertical laundry module 10 comprises one drawer, to lesser heights so that the vertical laundry module 10 can comprises multiple drawers. The drawer can be used to provide needed storage for laundry aids and additional equipment. The drawer can be compartmentalized for added organization. The close proximity of the vertical laundry module 10 to the laundry appliance 20 allows the user to readily access needed laundry aids and equipment stored in the drawer. The drawer can be mounted to slidably open from the front of the vertical laundry module 10. In one potential embodiment, the drawer height h is sufficiently sized so that a laundry aid can stand upright in the drawer without having to lie on a side. The preferred drawer height is preferably at least 10.5" and more preferably at least 11.7". The drawer can also be provided with additional elements such as trash bins, hanging rods, clothes baskets, or stacking storage bins. In each case, the drawer can be dimensioned to correspond to the function of the additional element. For example, a drawer having a hanging rod is dimensioned to allow fabric items to be hung.

The door can open from the front face 12*a* to reveal an interior storage space in the cabinet of the vertical laundry module 10. The interior storage space can be used to provide storage for laundry aids and additional equipment. The height of the interior storage space can vary, from being substantially equal to the height of the vertical laundry module 10 so that the vertical laundry module 10 comprises one door that covers the interior storage space, to lesser heights so that the vertical laundry module 10 can comprises multiple interior storage spaces, each with a separate door. The close proximity of the vertical laundry module 10 to the laundry appliance 20 allows the user to readily access needed laundry aids and equipment stored in the interior storage space. When closed, the door conceals the interior storage space to create a neat and organized appearance in the laundry room.

Any of the features of the drawer, the door, and the backsplash can be combined to form the vertical laundry module 10. One example is a vertical laundry module 10 having at least one drawer in combination with a storage area selectively closed by a door. Another example is a vertical laundry module 10 having a drawer and a backsplash. Yet another example is a vertical laundry module 10 having a storage area selectively closed by a door and a backsplash. Yet another example is a vertical laundry module 10 having a drawer, a storage area selectively closed by a door, and a backsplash. Each embodiment of the vertical laundry module 10 that comprises the backsplash has the common dimensional feature of having the same height and depth as the associated laundry appliance 20. Embodiments of the vertical laundry module 10 not comprising a backsplash have the same height as the associated laundry appliance 20, and while these embodiments are not dimensionally constrained by the depth of the associated laundry appliance 20, these embodiments can also have the same depth as the associated laundry appliance. Any of these embodiments can comprise more than one drawer or door.

The vertical laundry modules 10 can further comprise functional elements that increase the functionality of the vertical laundry module 10. The functional elements each have at least one associated function, and, in general, the functions for the vertical laundry module 10 can be grouped according to non-laundry care functions that are not associated with an actual treatment of the laundry and laundry care functions that are associated with an aspect of treating the laundry.

Exemplary non-laundry care functions include, but are not limited to, storage, staging, garbage and recycling collection, shelving, laundry sorting, hanging, bulk dispensing, resource management, resource supply and/or recovery/reclamation, resource treatment, lighting, refrigeration, entertainment, pet care, data collection and communication, home automation, home security, home safety, power outlet and supply, and module controller.

The storage function relates to storing anything, whether related to laundry care or to something else. Some items that are commonly stored in the laundry area are detergents, bleach, fabric softeners, irons, stain pre-treatment products, and household cleaning products. The items can be stored in an enclosed space so that the items are not visible unless accessed by the user, such as by opening the drawer or door. The staging function relates to placing items in a location that is exposed and readily available to the user without having to perform an action to make the items visible. Garbage and recycling collection are similar to storage, but the storage is specifically designated for the collection of garbage and recyclable materials. The shelving function corresponds to providing a generally horizontal surface that can optionally be retracted when not in use and extended when used for numerous purposes, including, but not limited to, sorting laundry, folding fabric items, and supporting a laundry basket. The laundry sorting function can relate to the shelving function, as described above, or to a plurality of bins designated for particular types of laundry. The bins can be differentiated based on type of fabric, such as delicates or regular, or color of the fabric items, such as lights or darks. The hanging function relates to providing a location to hang a fabric item, either directly on the location or through a hanger supported at the location. The bulk dispensing function is used in conjunction with the laundry appliance 20 and relates to storing a bulk supply of detergent or other chemicals and dispensing a charge of the detergent or other chemicals to the laundry appliance 20 upon request from the laundry appliance 20 to clean the fabric items. In this case, the bulk supply is considered to be an amount greater than the charge. Examples of the laundry aid include, but are not limited to, a laundry detergent, liquid fabric softener, bleach, or other substance used for cleaning fabric in a washing machine or clothes dryer. The resource management function deals with managing electrical and/or water supply to the vertical laundry module 10 and/or to the laundry appliance 20 and/or to other areas of the home. The available electrical and water resources can be managed to ensure that the vertical laundry module 10 and the laundry appliance 20 properly function without detrimentally affecting the performance of the other vertical laundry modules 10 and laundry appliances 20. The resource supply and/or recovery/reclamation function relates to providing resources to the vertical laundry module 10 and/or laundry appliance 20 and/or reclaiming the resources from the vertical laundry module 10 and/or laundry appliance 20. For example, the reclamation unit of the aforementioned non-aqueous washing apparatus performs the resource supply and/or recovery/reclamation function. Other examples of this function include, but are not limited to, water supply and recovery and suds and additive recovery. The resource treatment function relates to treating a resource that is supplied to the vertical laundry module 10 and/or laundry appliance 20. Examples of the treatment include, but are not limited to, water heating, water filtering, and water softening. The lighting function corresponds to providing illumination either as general lighting to the laundry area or as task lighting to a specific area of the vertical laundry module 10 and/or the laundry appliance 20 for performing a particular task. For example, the task lighting can include a black light to facilitate identification of spots and stains on fabric items. The refrigeration function relates to cooling a chamber in the vertical laundry module 10 so that items, such as food items, can be stored in the cooled chamber and kept at a desired temperature. The entertainment function relates to providing audio and/or visual media that entertains the user. Examples of components that can be integrated into or mounted to the vertical laundry module 10 for providing the entertainment function include, but are not limited to, a television, a video player, such as a VCR, DVD player, and DVR, or an audio player, such as a radio, a cassette player, a record player, a CD player, and a digital music player, such as an MP3 player. The pet care function corresponds to providing food or water to a household pet or a location where the household pet can urinate or defecate, such as a kitty litter.

The data collection and communication function corresponds to receiving data from the vertical laundry module 10 and/or the laundry appliance 20 related to the operation of the vertical laundry module 10 and/or the laundry appliance 20 and communicating the data, such as through a network, to a computer or other device. The home automation function relates to participating in a system for controlling operation of various devices in the home. For example, several devices, including the vertical laundry module 10 and the laundry appliance 20, can be included in the system and controlled remotely or automatically. The home security function relates to providing a home security system to detect intruders in the home, and the home safety function relates to detecting harmful substances, such as fire and smoke detection and carbon monoxide detection. The power outlet function corresponds to providing an electrical plug receptacle into which various electronic devices can be plugged for receiving power. The power can be provided by an external power supply, such as the main power supply for the home, or a compact power supply, such as a battery stored in the vertical laundry module 10. The module controller function relates to providing a user-interactive control panel for controlling operation of the vertical laundry module 10. The control panel can receive input from the user, such as input regarding desired operational modes for the vertical laundry module 10, and can communicate output to the user, such as output related to the operational status of the vertical laundry module 10 and/or the laundry appliance 20.

Exemplary laundry care functions include, but are not limited to, washing, drying, refreshing, sanitizing, sink, ironing, hand steaming, and stain treatment. The washing function corresponds to subjecting a clothing item to a wash process wherein wash liquid is used to clean the fabric item, such as hand-washing clothing items in a sink, which is especially suited for delicate items, including lingerie and sweaters. The drying function relates to evaporation of liquid from a fabric item by subjecting the fabric item to forced air, which can optionally be heated. The fabric item can be hung or laid flat for non-tumble drying. The refreshing function involves exposing the fabric item to a refreshing medium for wrinkle removal and/or odor removal of the fabric item without fully washing the fabric item. The refreshing function thereby improves the appearance and smell of the fabric item. The sanitizing function is similar to the refreshing function, except that the fabric item is exposed to a sanitizing medium that disinfects the fabric item by removal of germs, microbes, and the like. The refreshing and sanitizing functions can be performed independently of one another or simultaneously. For example, the fabric item can be exposed to steam, which can reduce wrinkles and odors from clothing (the refreshing function) while removing germs (the sanitizing function), or the fabric item can be exposed to air containing a material that imparts a pleasant scent, such as in the form of a cool mist, to the fabric item (the refreshing function). The refreshing and/or sanitizing functions can utilize misting technologies, which can use nebulizers that incorporate chemicals that remove wrinkles, odors, germs, microbes, and combinations thereof. The sink function can involve several processes, such as soaking the fabric item to wash the fabric item or to treat a stain prior to washing or simply wetting the fabric item. The ironing and hand steaming functions relate to removing wrinkles from the fabric item with an iron and a hand steamer, respectively. The stain treatment function removes a stain on a fabric item without washing the fabric item or treats the stain before washing the fabric item. The stain treatment function conserves water, electricity, and laundry aids since fabric items can be spot-cleaned instead of washed in a full load. In turn, fewer loads of fabric items will need to be cleaned in the washing machine and dryer.

Figure 3:
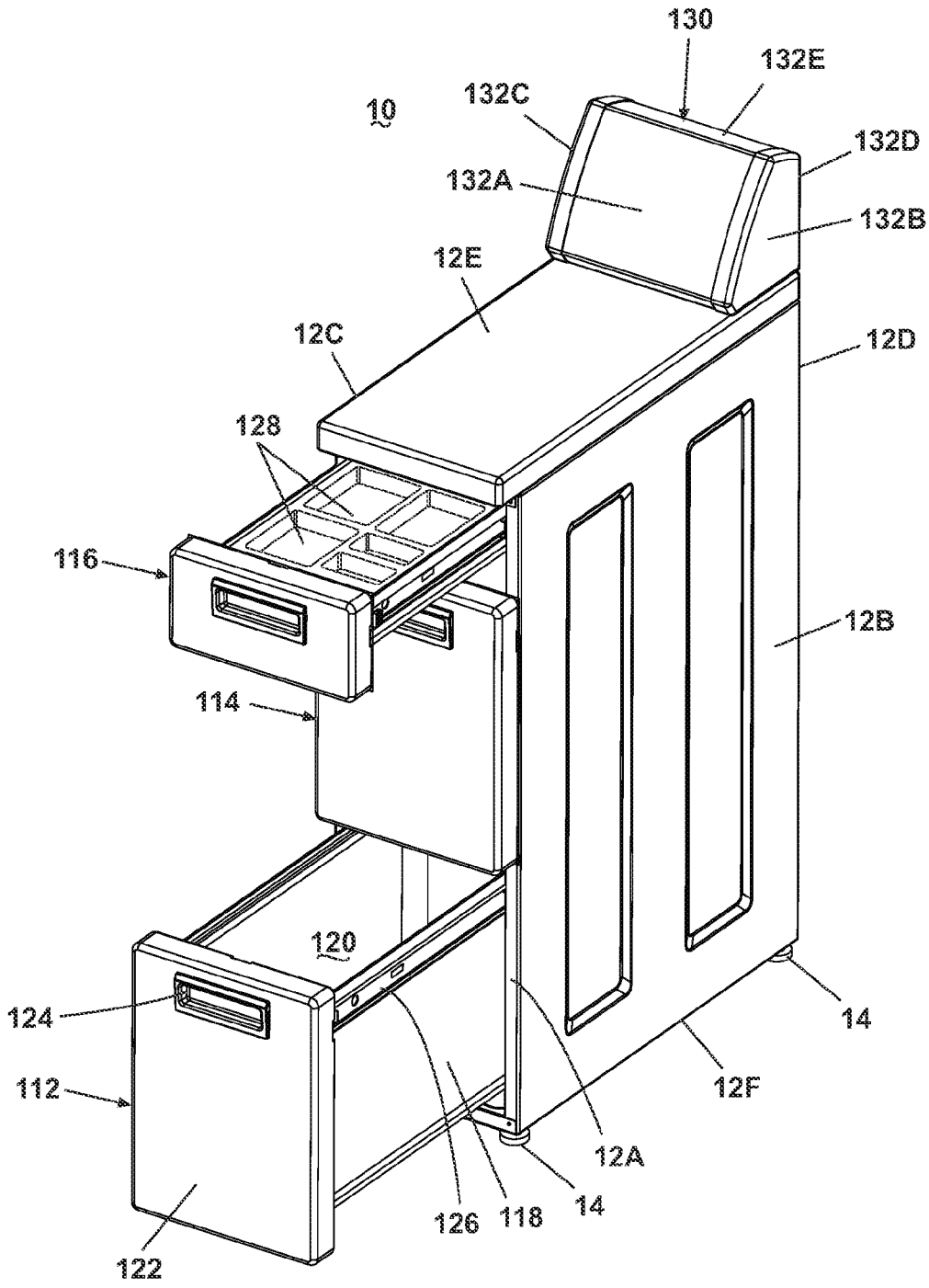
FIG. 3 is a perspective view of a first embodiment of the vertical laundry module wherein the module comprises multiple drawers and a backsplash.

Specific embodiments of vertical laundry modules 10 containing these features and functionality will now be described. Referring to FIG. 3, according to a first embodiment of the invention, the vertical laundry module 10 has approximately the same height and depth as the associated laundry appliance 20, as described previously, and comprises three drawers 112, 114, 116 that slidably open from the front face 12*a* of the vertical laundry module 10 and a backsplash 130. The drawer 112, shown extended from the vertical laundry module 10, and the drawer 114, shown retracted into the vertical laundry module 10, are similar in size while the drawer 116, also shown extended from the vertical laundry module 10, is shallower. The vertical laundry module 10 further comprises four supports 14 that are connected to the bottom face 12*f*. The supports 14 are illustrated as posts on which the vertical laundry module 10 rests, however, the supports 14 can also comprise wheels so that the vertical laundry module 10 is mobile and can easily be moved to a different location, for example, to clean underneath or behind the vertical laundry module 10.

The basic structure of the drawer will be described with reference to the lowermost drawer 112. The drawer 112 comprises a drawer body 118 defining an interior storage space 120 and an open top allowing the user to access the interior storage space 120 when the drawer 112 is extended from the vertical laundry module 10. A front panel 122 is further joined to the front wall of the drawer body 118 using any suitable fastening means. The front panel 122 has a handle 124 integrally formed on the front surface of the front panel 122 to enable the user to pull the drawer 112 from the vertical laundry module 10 to access the interior storage space 120. The drawer 112 can be mounted to slidably open from the front face 12*a* using any suitable mounting means. For example, a runner 126 can be attached to the outer surface of the right and left side walls of the drawer body 118 that interacts with a corresponding track or wheels (not shown) attached to the inside surface of the right and left side faces 12*b*, 12*c* of the vertical laundry module 10.

The drawer 116 of comprises multiple integral compartments 128 formed in interior of the drawer 116. The compartments 128 can be formed on a separate tray dimensioned to fit within the interior of the drawer 116 so that the compartments 128 can optionally be removed from the drawer 116.

The backsplash 130 comprises a front face 132*a*, a right side face 132*b*, a left side face 132*c*, rear face 132*d*, and a top face 132*e*. The backsplash 130 is mounted on the top face 12*e* of the laundry module 10 and extends substantially the width w of the vertical laundry module 10 such that the right side face 132*b*, left side face 132*c*, and rear face 132*d* of the backsplash 130 are respectively aligned with the right side face 12*b*, left side face 12*c*, and rear face 12*d* of the vertical laundry module 10. The front face 132*a* of the illustrated embodiment is devoid of any controls or features.

Figure 4A:
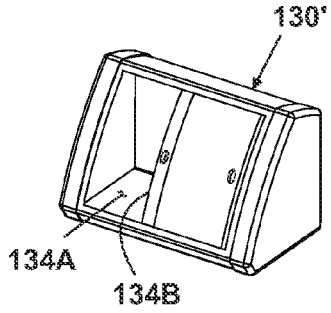
FIGS. 4*a*-4*d* are perspective views of alternate embodiments of the backsplash shown in FIG. 3.
Figure 4B:
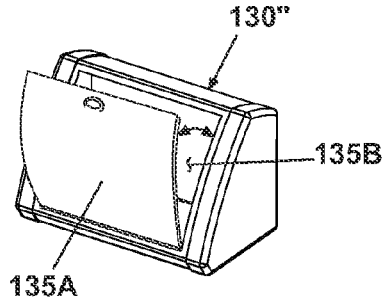
Figure 4C:
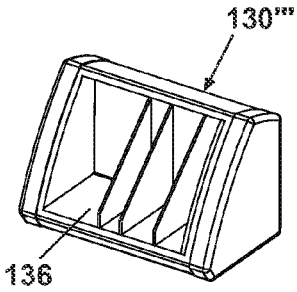
Figure 4D:
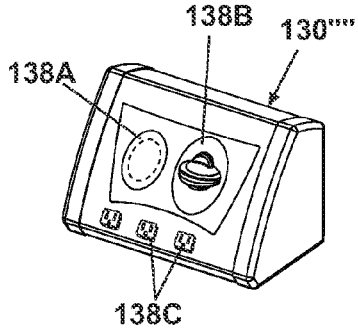

The backsplash 130 can comprise one or more of the functional elements described above for the vertical laundry module 10, including, but not limited to, storage, staging, lighting, module controller, and power outlet. FIGS. 4*a*-4*c* show some of the possible functions that can be incorporated in the backsplash 130. Referring to FIG. 4*a*, the backsplash 130' can comprise a storage function in the form of a storage compartment 134*a* with, for example, a sliding door 134*b* covering the compartment. Referring to FIG. 4*b*, the backsplash 130" can comprise a storage function in the form of a pivoting storage compartment 135*a* that opens from the front of the backsplash 130" to reveal an interior storage bin 135*b*. Referring to FIG. 4*c*, the backsplash 130''' can comprise a staging function in the form of an open storage compartment 136 that allows for convenient access to laundry aids used right before or right after laundry washing or drying such as a stain treatment product, a bleach product, a spray de-wrinkler, or the like. Referring to FIG. 4*d*, the backsplash 130"" can comprise a lighting function in the form of a light 138*a* for illuminating an area on top of the vertical laundry module 10, a module controller function in the form of a control panel 138*b*, and a power outlet function in the form of multiple electrical outlets 138*c* for electrically connecting small appliances, such as an iron. The light 138*a* can be a standard light or a black light useful for illuminating stains on fabric items.

Figure 5A:
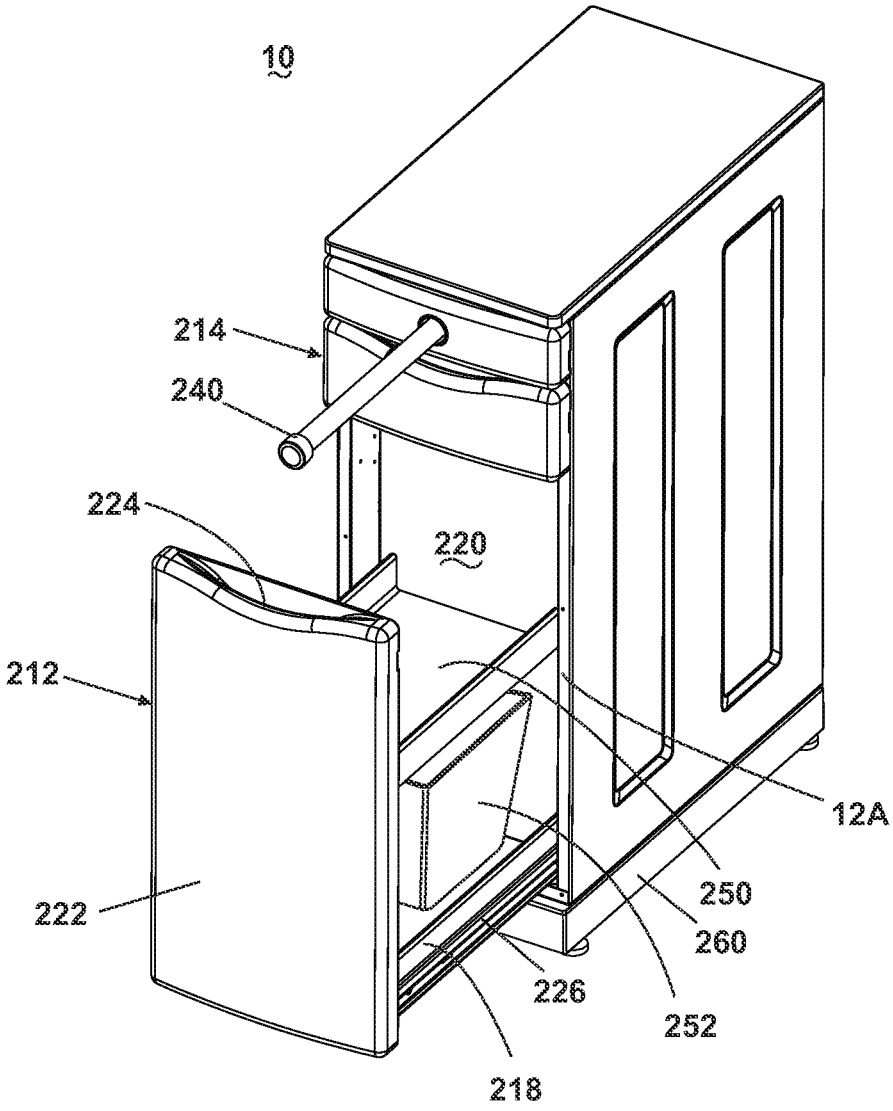
FIG. 5*a* is a perspective view of a second embodiment of the vertical laundry module, wherein the module comprises two drawers and a hanging rod in an extended position.
Figure 5B:
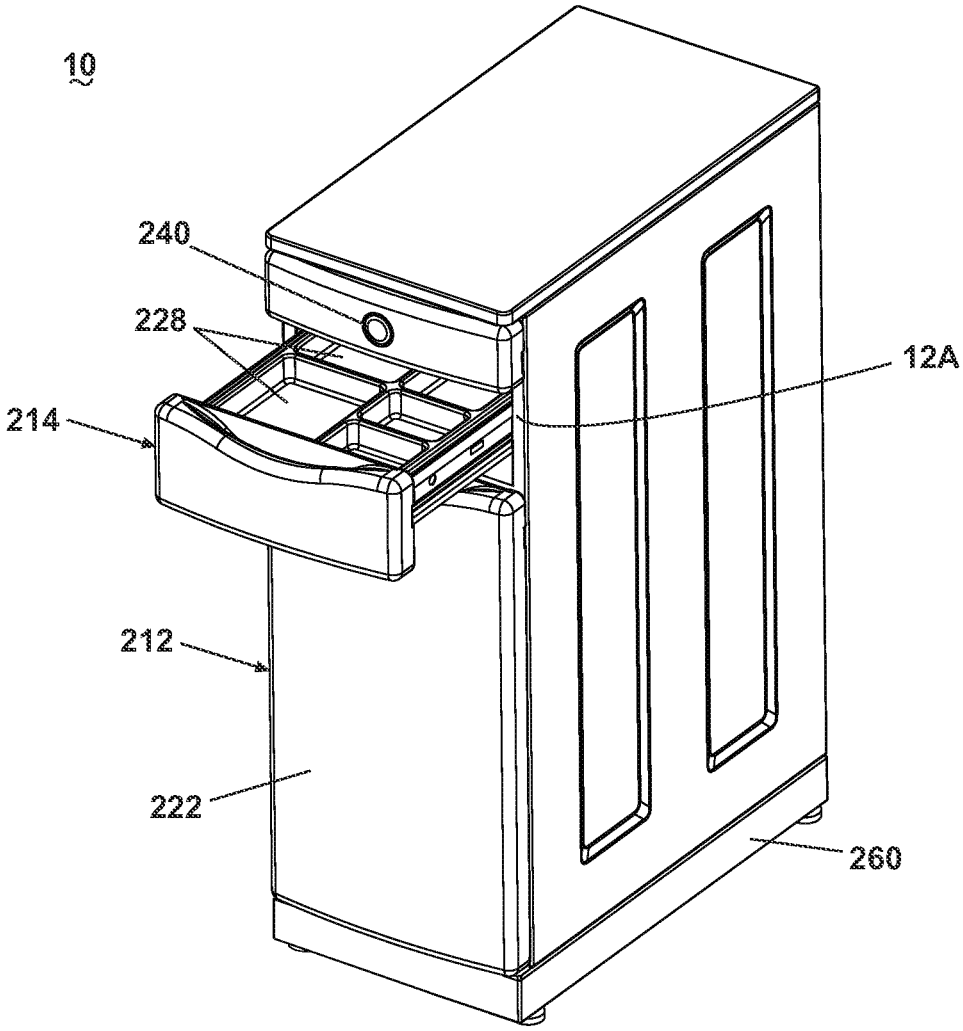
FIG. 5*b* is a perspective view of the vertical laundry module of FIG. 5*a* illustrating the hanging rod in a retracted position.

The vertical laundry module 10 can comprise different non-laundry care functions. For example, the vertical laundry module 10 can comprise the combination of a storage function, a shelving function, and a hanging function. Referring to FIGS. 5*a*-5*b*, a second embodiment of the vertical laundry module 10 is shown wherein the vertical laundry module 10 has approximately the same height as the associated laundry appliance 20, as described previously, and comprises two drawers 212, 214 and a cantilever-type hanging rod 240 that is extendable/retractable from the laundry module 10.

The drawer 212 comprises a drawer body 218 defining an interior storage space 220. A front panel 222 is further joined to the front wall of the drawer body 218 using any suitable fastening means. The front panel 222 has a handle 224 integrally formed along the top edge of the front panel 222 of the drawer 212 to enable the user to pull the drawer 212 from the vertical laundry module 10 to access the interior storage space 220. The drawer 212 can be mounted to slidably open from the front face 12*a* using any suitable mounting means. For example, a runner 226 can be attached along the lower outer surface of the right and left side walls of the drawer body 118 that interacts with a corresponding track or wheels (not shown) attached to the inside surface of the vertical laundry module 10.

The drawer body 218 can comprise open sides and a shelf 250. The open sides allow the user to easily access the contents of the drawer 212 and to easily insert and remove large items. The shelf 250 can be adjustable to adjust the vertical position of the shelf 250 or to completely remove the shelf 250. The shelf 250 can have a solid surface, a perforated surface, such as a mesh screen suitable for flat-drying fabric items, or a combination of both surface types. The drawer 212 can also contain a removable receptacle 252, such as a waste bin for trash or items to be recycled, or a hamper for fabric items to be washed. The drawer 212 can be provided with multiple removable receptacles 252 that can be used to sort items, such as sorting fabric items into loads to be cleaned by color or fabric type.

The drawer 214, shown retracted into the vertical laundry module 10 in FIG. 5*a* and extended from the vertical laundry module in FIG. 5*b*, is shallower than drawer 212 and comprises multiple integral compartments 228 formed in interior of the drawer 214. The compartments 228 can be formed on a separate tray dimensioned to fit within the interior of the drawer 214 so that the compartments 228 can optionally be removed from the drawer 214.

The hanging rod 240 comprises a cantilever-type rod that can be extended from a storage compartment formed in the vertical laundry module 10 as shown in FIG. 5*a*. The hanging rod 240 is provided on the vertical laundry module 10 as a convenient place to hang fabric items when the hanging rod 240 is extended. When not needed, the hanging rod 240 can be retracted into the storage compartment and out of the way of the user as shown in FIG. 5*b*. The hanging rod 240 can be operated by a push-push mechanism, whereby the end of the hanging rod 240 in the retracted position is pushed inward to release the hanging rod 240 to the extended position and pushed inward a second time to retract the hanged rod 240 into the vertical laundry module 10. The hanging rod 240 is more fully disclosed in application Ser. No. 11/322,503, filed Dec. 30, 2005, now U.S. Pat. No. 7,954,914, and titled "Retractable Hanging Element," which is incorporated herein by reference in its entirety.

As shown in FIGS. 5*a* and 5*b* the vertical laundry module 10 can optionally comprise a pedestal 260 that is mounted to the bottom of the vertical laundry module 10. The width and depth of the pedestal 260 are approximately equal to the width w and depth d of the vertical laundry module 10. The height of the pedestal 260 can vary. The pedestal 260 functions as an adapter so that the vertical laundry module 10 can be used with different models of laundry appliances 20 that have different heights H. This allows the user to tailor the height of the vertical laundry module 10 to an existing laundry appliance 20 or to a laundry appliance 20 purchased at a later time. The pedestal 260 can be added to any of the embodiments of the vertical laundry module 10 discussed herein. Similar to the case when the vertical laundry module 10 is stacked on top of the horizontal module 26 (FIG. 2*f*), when the vertical laundry module 10 comprises the pedestal 260, the effective upper surface of the vertical laundry module 10 is the upper surface of the vertical laundry module 10.

Figure 6:
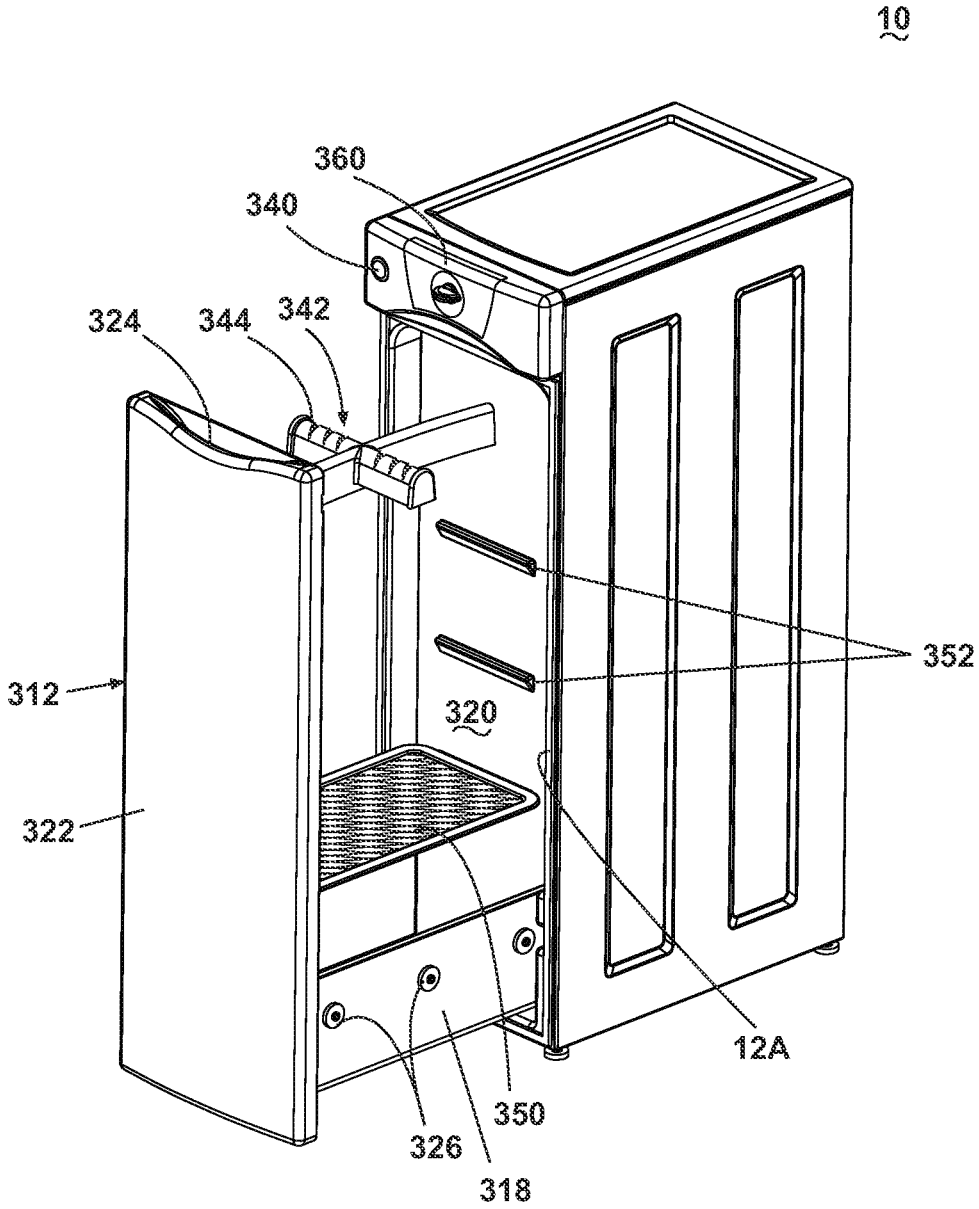
FIG. 6 is a perspective view of a third embodiment of the vertical laundry module comprising a drying, refreshing, and/or sanitizing function.

The vertical laundry module 10 can comprise a non-laundry care function and a laundry care function. For example, the vertical laundry module 10 can comprise the combination of a storage function, a shelving function, a sorting function, a hanging function, a drying function, and a refreshing and/or sanitizing function. Referring to FIG. 6, a third embodiment of the vertical laundry module 10 is shown wherein the vertical laundry module 10 has approximately the same height as the associated laundry appliance 20 and comprises a drawer 312, a cantilever-type hanging rod 340, a hanging rod 342 and a shelf 350 positioned inside the drawer 312, and a control panel 360 for controlling the drying, refreshing, and/or sanitizing functions.

The drawer 312 comprises a drawer body 318 defining an interior drying/refreshing/sanitizing space 320. A front panel 322 is further joined to the front wall of the drawer body 318 using any suitable fastening means. The front panel 322 has a handle 324 integrally formed along the top edge of the front panel 322 of the drawer 312 to enable the user to pull the drawer 312 from the vertical laundry module 10 to access the interior space 320. The drawer 312 can be mounted to slidably open from the front face 12*a* using any suitable mounting means. For example, multiple guide rollers 326 can be attached to the outer surface of the right and left side walls of the drawer body 318. The guide rollers 326 interact with a corresponding track (not shown) attached to the inside surface of the vertical laundry module 10.

The hanging rod 342 and the shelf 350 are positioned in the interior space 320 of the drawer body 318. The hanging rod 342 can have spaced notches 344 for hangers to space fabric items so that hanging items do not shift and bunch as the drawer 312 is slid open and shut. The hanging rod 342 can further be removably mounted in the drawer 312 so that the hanging rod 342 can optionally be removed from the drawer 312.

The shelf 350 can be positioned in the drawer 312 at a distance from the hanging rod 342 such that the shelf 350 will be below any fabric items hung on the hanging rod 342 or can be removed from the drawer 312 to accommodate hanging fabric items that require more space. The shelf 350 can have a solid surface, a perforated surface, such as a mesh screen suitable for flat-drying fabric items, or a combination of both surface types. The front and rear walls of the drawer body 318 can have multiple horizontal brackets 352 for removably mounting additional shelves, for example when the hanging rod 342 is removed or when fabric items are not being hung from the hanging rod 342.

The hanging rod 340 comprises a cantilever-type rod similar to hanging rod 240 (FIGS. 5*a*-5*b*) that can be extended from n the vertical laundry module 10 or retracted into the vertical laundry module 10 and out of the way of the user as shown in FIG. 6. The hanging rod 340 can be operated by a push-push mechanism as described above.

To utilize the drying function, fabric items are hung from the hanging rod 342 or laid on the shelf 350, and air is forced through the interior space 320. Air can be ducted in from the laundry appliance 20 in the form of the clothes dryer or can be generated independently so that the drying function can be used when the clothes dryer is not in operation. In either case, the air can optionally be heated. Similarly, to utilize the refreshing and/or sanitizing function, fabric items are hung from the hanging rod 342 or laid on the shelf 350 and exposed to a suitable refreshing and/or sanitizing medium. Two or more of the drying, refreshing, and sanitizing functions can be performed simultaneously. The control panel 360 can be used to control various aspects of the drying, refreshing, and sanitizing functions, including, but not limited to, cycle time, forced air temperature, refreshing medium temperature, and sanitizing medium temperature. The vertical laundry module 10 can also singularly comprise a drying function, a refreshing function or a sanitizing function or can comprise any combination of the three.

Figure 7:
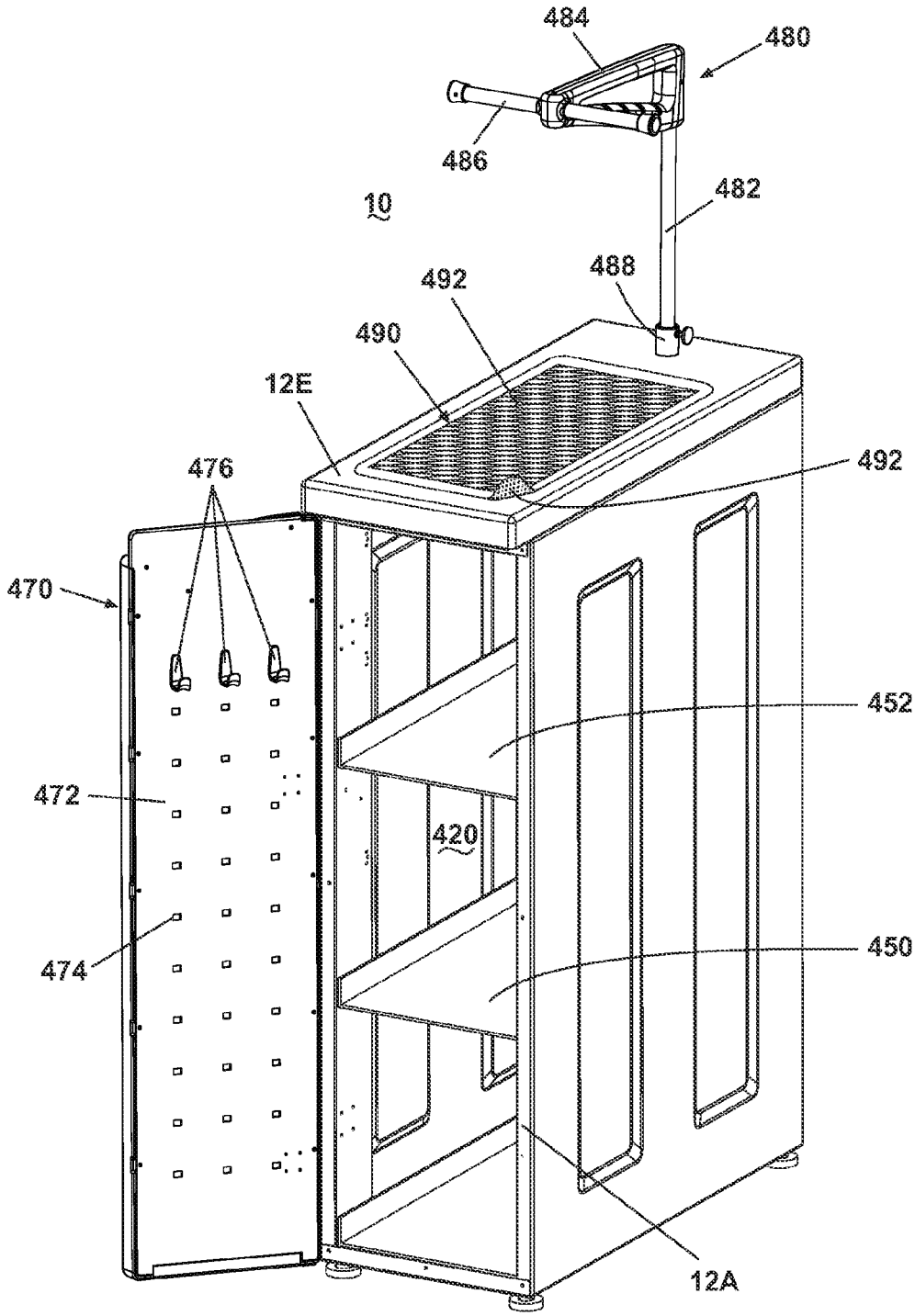
FIG. 7 is a perspective view of a fourth embodiment of the vertical laundry module comprising an interior storage space closed by a door.

The vertical laundry module 10 can comprise a storage function in the form of a door closing an interior storage space and a hanging function. Referring to FIG. 7, a fourth embodiment of the invention is shown wherein the vertical laundry module 10 has approximately the same height as the associated laundry appliance 20 as described previously and comprises an interior storage space 420 closed by a door 470 and a hanging T-bar 480. The door 470 opens from the front face 12*a* of the vertical laundry module 10 to reveal the interior storage space 420. A handle (not shown) can be formed on the front surface of the door 470 to enable the user to grip the handle and pull the door 470 open.

Two shelves 450, 452 are positioned in the interior storage space 420. The shelves 450, 452 can be adjustable to adjust the vertical positions of the shelves 450, 452 or to completely remove the shelves 450, 452. The shelves 450, 452 can have a solid surface, a perforated surface, such as a mesh screen suitable for flat-drying fabric items, or a combination of both surface types.

The door 470 can comprise a peg board 472 located on the inside surface of the door 470. The peg board 472 comprises multiple holes 474 fittable with hooks 476 or other devices that can be used, for example, for hanging tools or other items. The peg board 472 can be integrally formed with the door 470 or can be a separate component mounted to the door 470 in any suitable manner.

Additionally, the hanging function is also carried out by the hanging T-bar 480 mounted to a top face 12*e* of the vertical laundry module 10. The hanging T-bar 480 comprises a post 482 slidably mounted to the top face 12*e*, a generally triangular body 484 at an upper end of the post 482, and a generally horizontal bar 486 mounted at a forward end of the body 484. Fabric items can be hung, such as on a hanger, from the bar 486, and the height of the bar 486 relative to the top 12*e* face can be adjusted by sliding the post 482 upward or downward and securing the post 482 in a desired position by a clamp 488. The hanging T-bar 480 can further be removed from the clamp 488 to remove the hanging T-bar 480 from the vertical laundry module 10.

The vertical laundry module 10 shown in FIG. 7 can also comprise a removable mat 490. The mat 490 can comprise a first side 492 and a second side 494 such that the mat 490 can be positioned with the first side 492 facing upwards, as shown in FIG. 7, or the mat 490 can be removed and flipped over, so that the second side 494 faces upwards. Each side 492, 494 can have a different color, pattern, and/or texture that can, for example, be used for different tasks or functions. The mat 490 can cover the vertical laundry module 10 or both the vertical laundry module 10 and the laundry appliance 20.

Figure 8A:
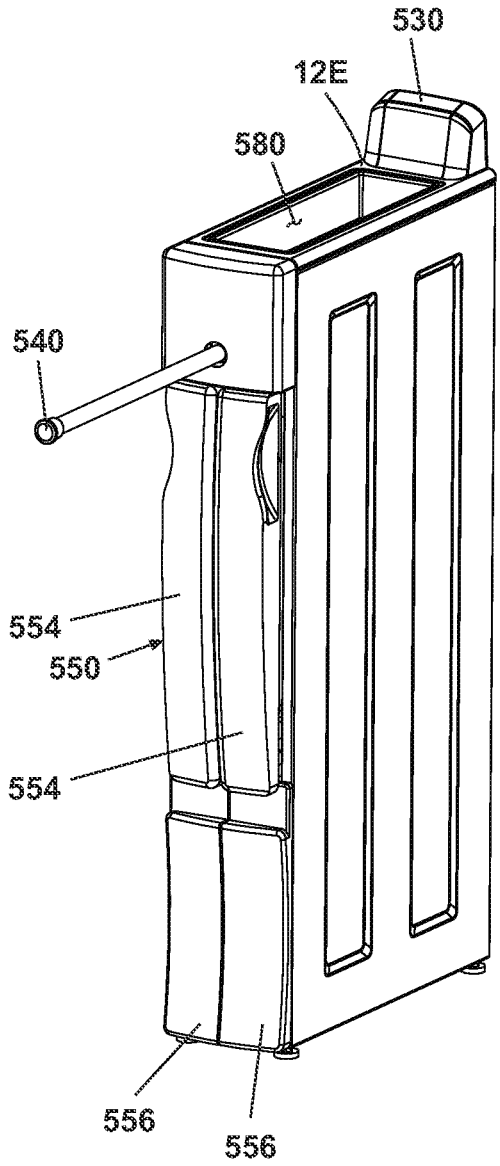
FIG. 8*a* is a perspective view of a fifth embodiment of the vertical laundry module comprising a fold-out shelf in a stored position.
Figure 8B:
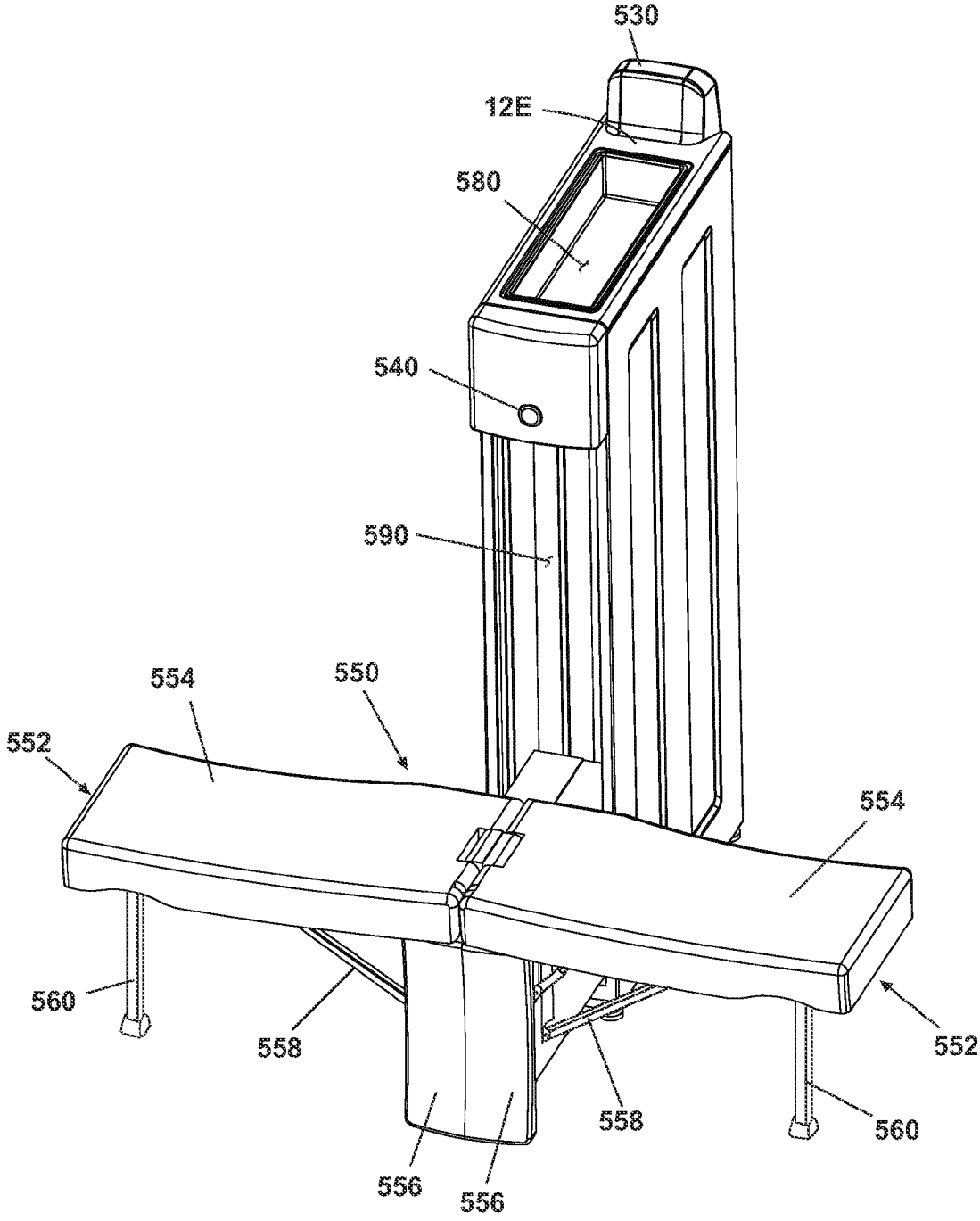
FIG. 8*b* is a perspective view of the vertical laundry module shown in FIG. 8*a* with a fold-out shelf in an extended position.

Another example of a combination of multiple non-laundry care functions for a vertical laundry module 10 is the combination of a shelving function, a staging function, and a hanging function. Referring to FIGS. 8*a*-8*b*, a fifth embodiment of the vertical laundry module 10 is shown wherein the vertical laundry module 10 has approximately the same height and depth as the associated laundry appliance 20 and comprises a fold-out shelf 550, a cantilever-type hanging rod 540, an open storage compartment 580, and a backsplash 530.

The fold-out shelf is more completely described in application Ser. No. 11/323,658, filed Dec. 30, 2005, now U.S. Pat. No. 7,587,917, and titled "Modular Laundry System with Shelf Module," which is incorporated herein by reference in its entirety. The shelf comprises a right and left shelf assemblies 552 that respectively comprise upper, shelf portions 554 and lower, base portions 556. The base portions 556 are mounted for sliding movement relative to a compartment 590 in the vertical laundry module 10 such that each base portion 556 can be moved independently of the other and a single shelf assembly 552 can be extended from the vertical laundry module 10 at a time. Movable support tubes 558 are connected at one end to the respective base portions 556 and at a second end to the respective shelf portions 554. The support tubes 558 are movable with the respective shelf portions 554 as the shelf portions 554 pivot relative to the respective base portions 556. Legs 560 are connected at one end to the shelf portions 554 and are movable relative to the shelf portion 554. FIG. 8*a* illustrates the fold-out shelf in a stored position wherein the fold-out shelf is contained within the compartment 590, wherein the shelf portions 554, support tubes 558, and legs 560 are in a generally vertical orientation. FIG. 8*b* illustrates the fold-out shelf in an extended position, wherein the fold-out shelf is located exteriorly of the compartment 590, and the shelf portions 554 are in a generally horizontal orientation and supported, at least in part, by the support tubes 558 and legs 560.

The hanging rod 540 comprises a cantilever-type rod similar to hanging rod 240 (FIGS. 5*a*-5*b*) that can be extended from the vertical laundry module 10 as shown in FIG. 8*b* or retracted into the vertical laundry module 10 and out of the way of the user as shown in FIG. 8*a*. The hanging rod 540 can be operated by a push-push mechanism as described above.

The open storage compartment 580 is positioned in the top face 12*e* of the vertical laundry module 10 such that it is forward from the backsplash 530. The open configuration of the storage compartment 580 allows the user to quickly and easily access items stored within the storage compartment 580.

The backsplash 530 is positioned on the top face 12*e* of the vertical laundry module 10 and is similar to the backsplash 130 (FIG. 3) described above. The backsplash 530 can incorporate any of the features discussed with reference to FIGS. 4*a*-4*c*.

Figure 9A:
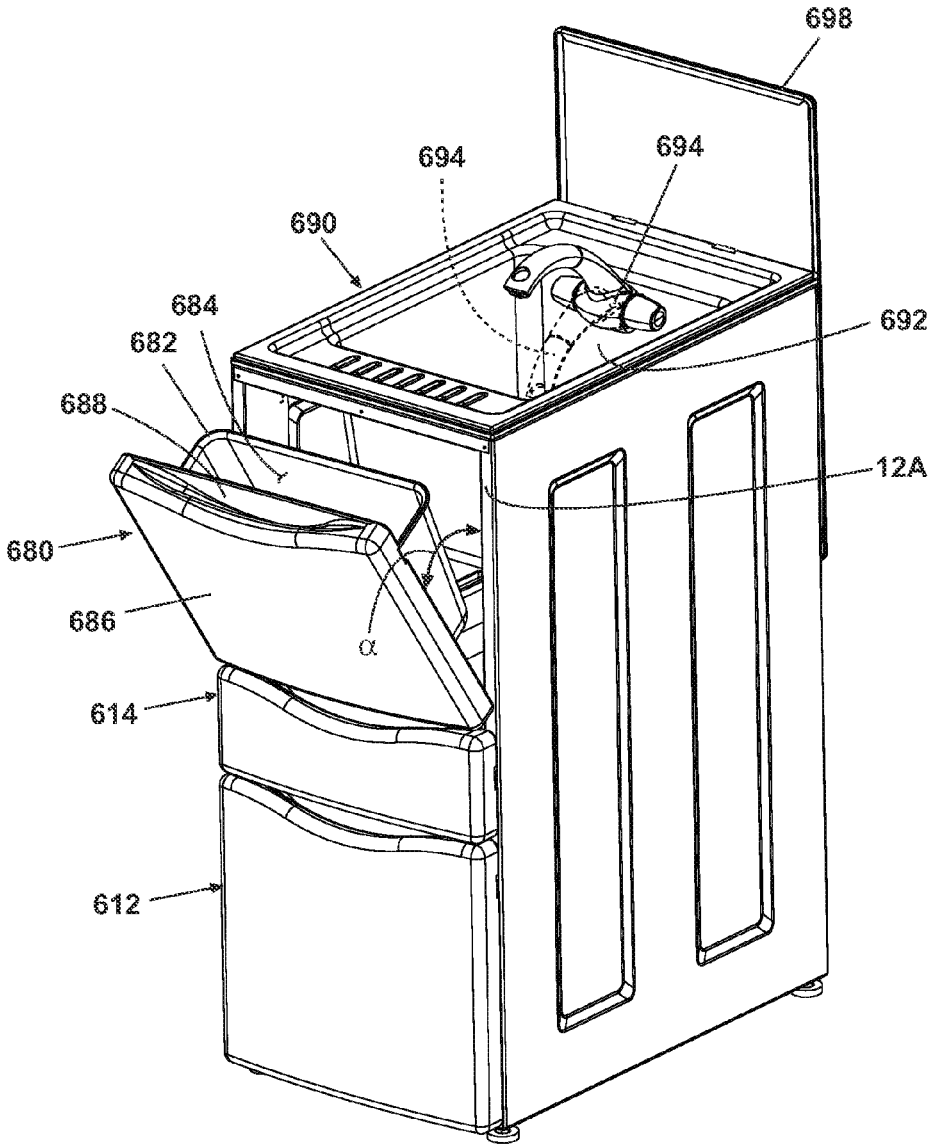
FIG. 9*a* is a perspective view of a sixth embodiment of the vertical laundry module comprising a sink.
Figure 9B:
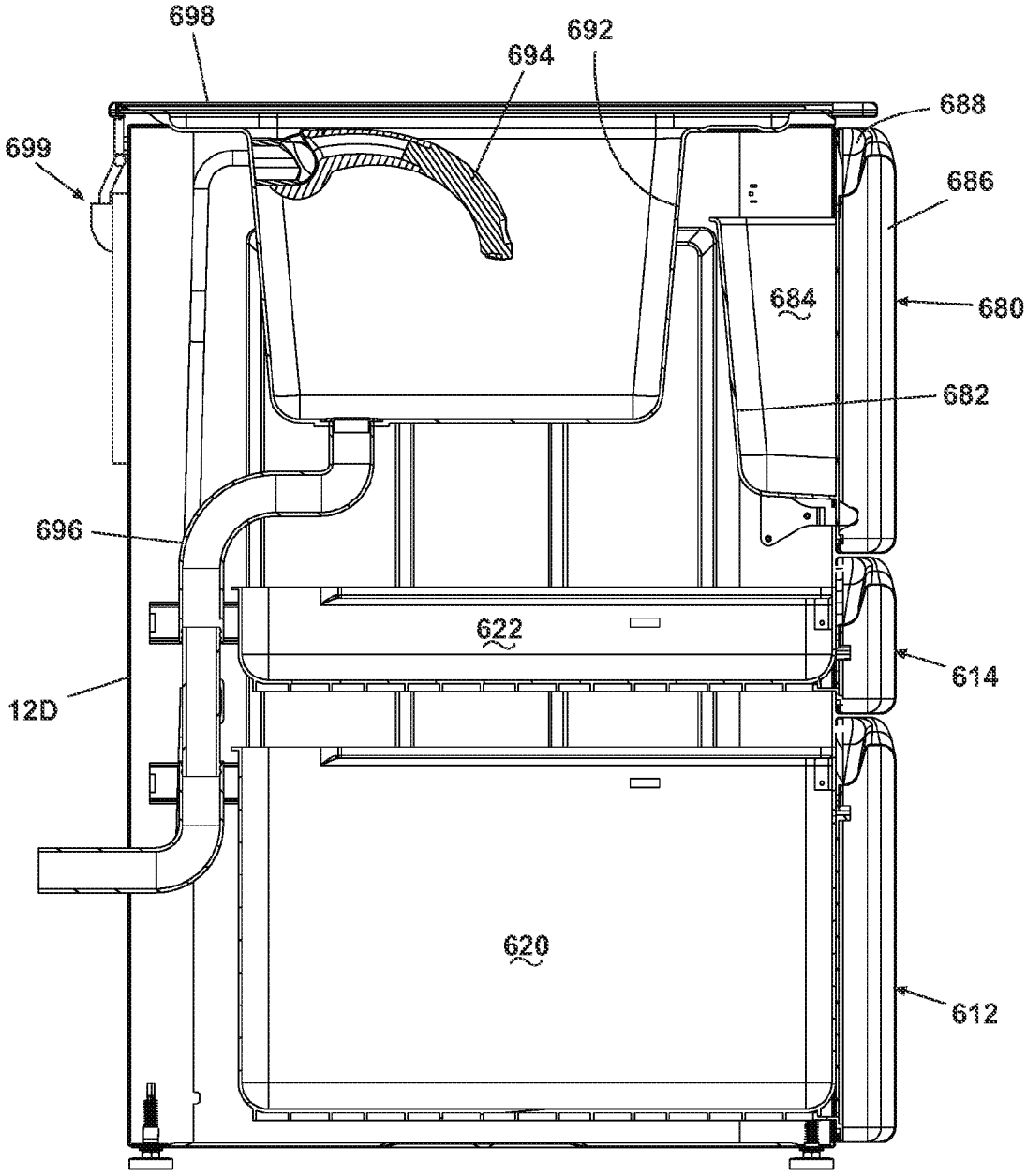
FIG. 9*b* is a cross-sectional view of the vertical laundry module shown in FIG. 9*a*.

The combination of a non-laundry care function and a laundry care function can comprise a storage function and a washing function. Referring to FIGS. 9*a*-9*b*, a sixth embodiment of the invention is shown wherein the vertical laundry module 10 has approximately the same height as the associated laundry appliance 20, as described previously, and comprises two drawers 612, 614, a pivoting storage compartment 680, and a sink 690. The vertical laundry module comprising a sink is more completely described in application Ser. No. 11/322,944, filed Dec. 30, 2005, now abandoned, and titled "Sink Station with Cover," which is incorporated herein by reference in its entirety.

The drawers 612, 614 are similar to the drawers discussed above for other embodiments of the invention and can comprise any of the features included on the other drawers. The drawers 612, 614 respectively define interior storage spaces 620, 622 and are mounted to slidably open from the front face 12*a* of the vertical laundry module 10 using any suitable mounting means. The topmost drawer 614 is positioned below the storage compartment 680 and the sink 690.

The pivoting storage compartment 680 utilizes the space in front of the sink 690 where a drawer cannot be positioned. The compartment 680 comprises an open-top bin 682 defining an interior storage space 684 that pivotably opens from the front face 12*a* of the vertical laundry module 10. A front panel 686 is attached from the front wall of the bin 682 and a handle 688 is integrally formed along the upper edge of the front panel 686. The compartment 680 can be opened to an acute angle $\alpha$ to access the bin 682 such that items in the bin 682 will not fall out when the compartment 680 is opened.

The sink 690 is positioned in the top of the vertical laundry module 10 and comprises a basin 692 defining an open top, a spout 694, and necessary plumbing, such as a drain pipe 696. The spout 694 is pivotable such that the spout 694 can extend upward from the basin 692, as illustrated in FIG. 9*a*, and can be folded into the basin 692 as shown in phantom line. A cover 698 is operably coupled to the vertical laundry module 10 such that the cover 698 is movable between a closed position (FIG. 9*b*) where the cover 698 overlies the open top of the basin 692 and a stored position (FIG. 9*a*). The cover 698 can be operably coupled to the vertical laundry module 10 through a coupling assembly 699 that allows the cover 698 to be lifted up to a generally vertical orientation and slid behind the vertical laundry module 10 along the rear face 12*d*. The cover 698 allows the sink 690 to be covered when not in use and forms the effective upper surface of the vertical laundry module 10 when in the closed position. The cover 698 and spout 694 can be mechanically linked so that when the cover 698 is moved from the closed position to the stored position, the spout 694 automatically pivots out of the basin 692 to an upright position, and when the cover 698 is moved from the stored position to the closed position, the spout 694 automatically pivots into the basin 692 to a stored position. The sink 690 can be plumbed into the laundry appliance 20 in the form of the washing machine or can have independent plumbing. The sink 690 can be used to treat stains on fabric items or to hand-wash or soak delicate fabric items.

The sixth embodiment of the invention can be modified to include a backsplash in which case the vertical laundry module 10 would have approximately the same depth as the associated laundry appliance 20, in addition to having approximately the same height. The cover 698 could be modified to hingedly connect to the vertical laundry module 10 in front of the backsplash.

Figure 10:
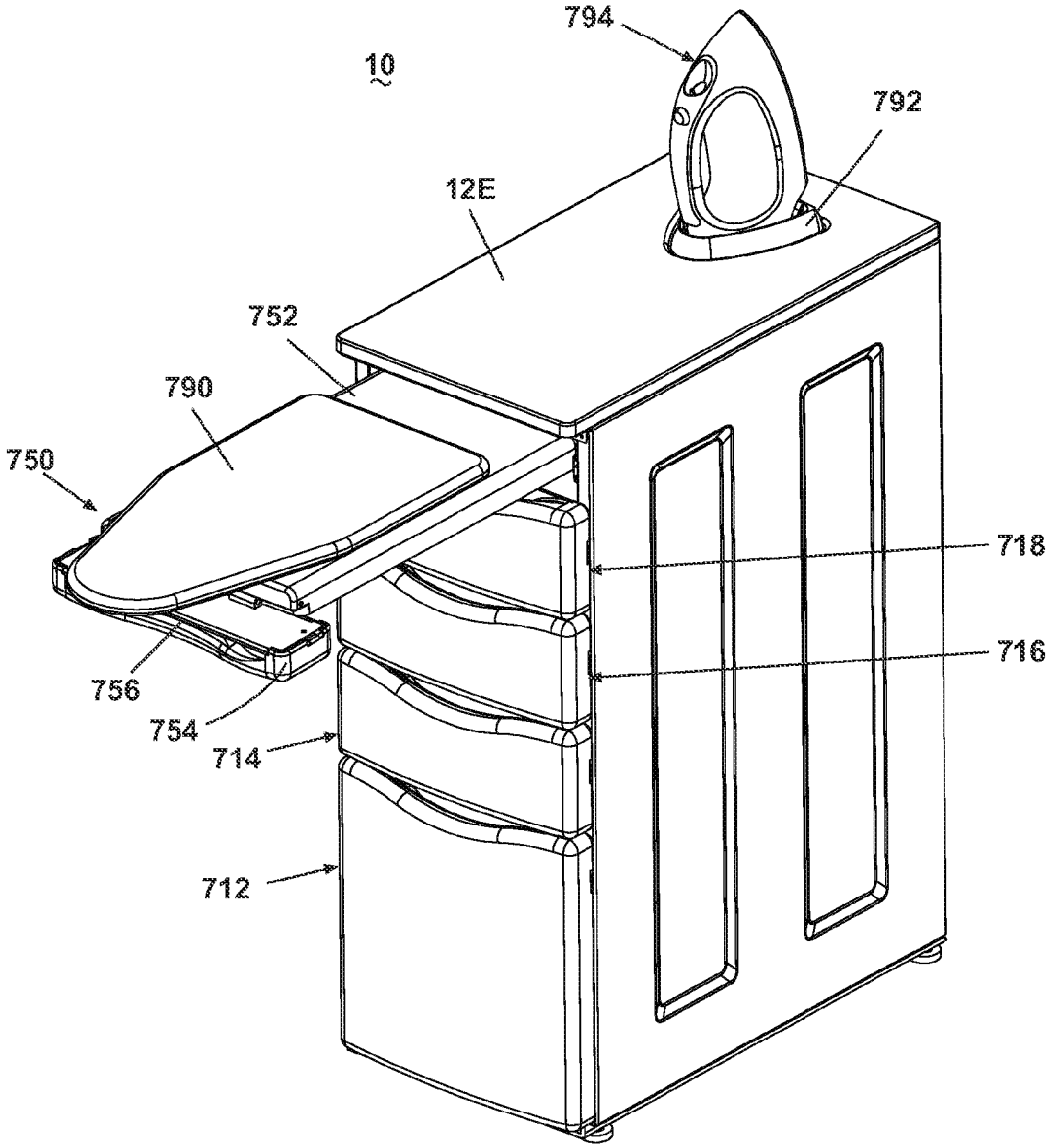
FIG. 10 is a perspective view of a seventh embodiment of the vertical laundry module comprising an ironing function.

The combination of a non-laundry care function and a laundry care function can comprise a storage function and an ironing function. Referring to FIG. 10, a seventh embodiment of the present invention is shown wherein the vertical laundry module 10 has approximately the same height as the associated laundry appliance 20, as described previously, and comprises four drawers 712, 714, 716, 718, a sliding shelf 750 comprising an ironing board 790, and a docking station 792 for charging a cordless iron 794. The vertical laundry module comprising an ironing function is more completely described in application Ser. No. 11/323,270, filed Dec. 30, 2005, now U.S. Pat. No. 7,555,856, and titled "Ironing Station," which is incorporated herein by reference in its entirety.

The drawers 712, 714, 716, 718 are similar to the drawers discussed above for other embodiments of the invention and can comprise any of the features included on the other drawers. The drawers 712, 714, 716, 718 define interior storage spaces and are mounted to slidably open from the front of the vertical laundry module 10 using any suitable mounting means.

The sliding shelf 750 comprises a shelf platform 752 that is mounted in the vertical laundry module 10 using any suitable mounting means such that the shelf 750 can slidably extend and retract from the vertical laundry module 10. A front panel 754 is connected to the forward end of the shelf platform 752 with a handle 756 integrally formed along the upper edge of the front panel 754. The shelf platform 752 movably supports an ironing board 790. The ironing board 790 can be slidably mounted to the shelf platform 752 on a track (not shown). The front panel 754 of the sliding shelf 750 can be configured to pivot forwardly to a generally horizontal orientation so that the ironing board 790 can be pulled forward to allow the pointed end of the ironing board 790 to extend forwardly of the front panel 754. The ironing board 790 can also be configured to pivot from the top face 12*e* of the vertical laundry module 10. The docking station 792 for charging the cordless iron 794 can be formed on the top face 12*e* of the vertical laundry module 10. The docking station 792 is preferably located near the rear of the top face 12*e*. Locating the docking station 792 at the rear of the top face 12*e* keeps the iron out of a small child's reach and provides a clear work area for the user in front of the docking station 792.

The seventh embodiment of the vertical laundry module 10 could also comprise the backsplash, in which case the vertical laundry module 10 would have approximately the same depth as the associated laundry appliance 20, in addition to having approximately the same height. The docking station 792 can be moved forward to accommodate the backsplash.

Figure 11:
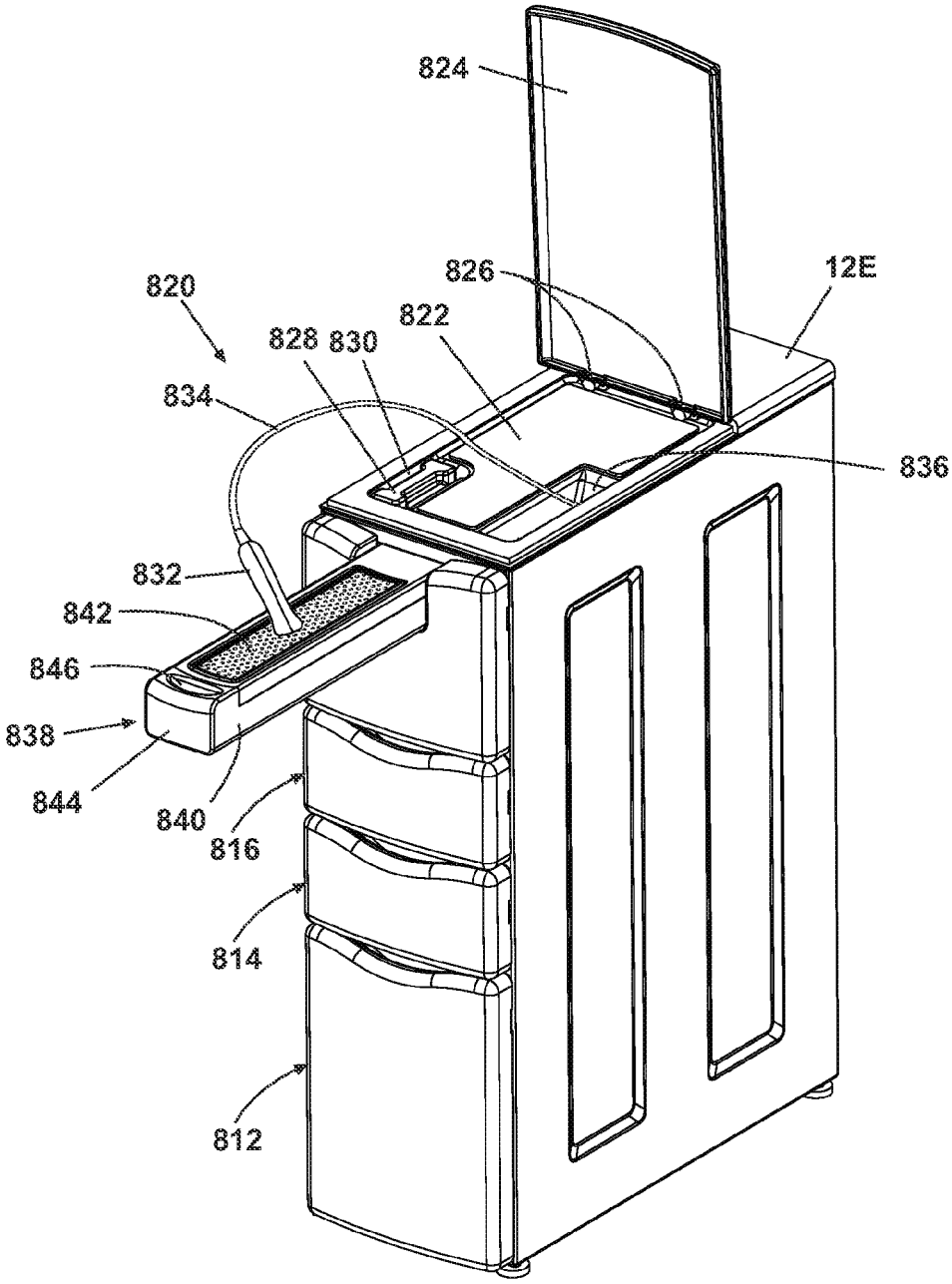
FIG. 11 is a perspective view of an eighth embodiment the vertical laundry module comprising a stain treatment function.

The combination of a non-laundry care function and a laundry care function can comprise a storage function and a stain treatment function. Referring to FIG. 11, an eighth embodiment of the present invention is shown wherein the vertical laundry module 10 has approximately the same height as the associated laundry appliance 20, as described previously, and comprises three drawers 812, 814, 816 and a stain treatment assembly 820.

The drawers 812, 814, 816 are similar to the drawers discussed above for other embodiments of the invention and can comprise any of the features included on the other drawers. The drawers 812, 814, 816 define interior storage spaces and are mounted to slidably open from the front of the vertical laundry module 10 using any suitable mounting means.

The stain treatment assembly 820 comprises a basin 822 with a pivoting cover 824 attached to the top face 12*e* by hinges 826. When the cover 824 is positioned to cover the basin 822 when not in use, the cover 824 is flush with the top face 12*e* of the vertical laundry module 10 to form a generally continuous surface with the associated laundry appliance 20. A supply container 828 for storing a supply of a stain treatment agent is mounted in a pocket 830 in the basin 822. A stain treatment wand 832 connected to a tube 834 is stored in another pocket 836 formed in the basin 822. The wand 832 and tube 834 can be extended from the pocket 836 to treat a stain on a fabric item and retracted into the pocket 836 for storage. The wand 832 and tube 834 are preferably fluidly connected to both the supply container 828 and a source of water or steam. The vertical laundry module 10 comprising the stain function can be plumbed into the laundry appliance 20 in the form of the washing machine for the source of water. A stain drawer 838 is provided near the top of the vertical laundry module 10 and forms a drain to receive used stain treatment agent. The stain drawer 838 comprises a hollow drawer body 840 and a mesh screen 842 disposed on the upper surface of the drawer body 840. A front panel 844 with an integrally formed handle 846 is attached to the drawer body 840. The stain drawer 838 forms a vacuum cavity in the drawer body 840 located beneath the mesh screen 842 and fluidly coupled to a source of vacuum mounted in the vertical laundry module 10. To use the stain treatment function, the stained fabric item is placed on the mesh screen 842, and the stain treatment agent is applied to the stain through the wand 830. The stain treatment agent is pulled through the fabric item by vacuum force and suctioned through the mesh screen 842.

The eighth embodiment of the vertical laundry module 10 can also comprise a backsplash, in which case the vertical laundry module 10 would have approximately the same depth as the associated laundry appliance 20, in addition to having approximately the same height. The backsplash can be positioned on the top face 12*e* of the vertical laundry module 10, rearwardly of the cover 824.

Figure 12:
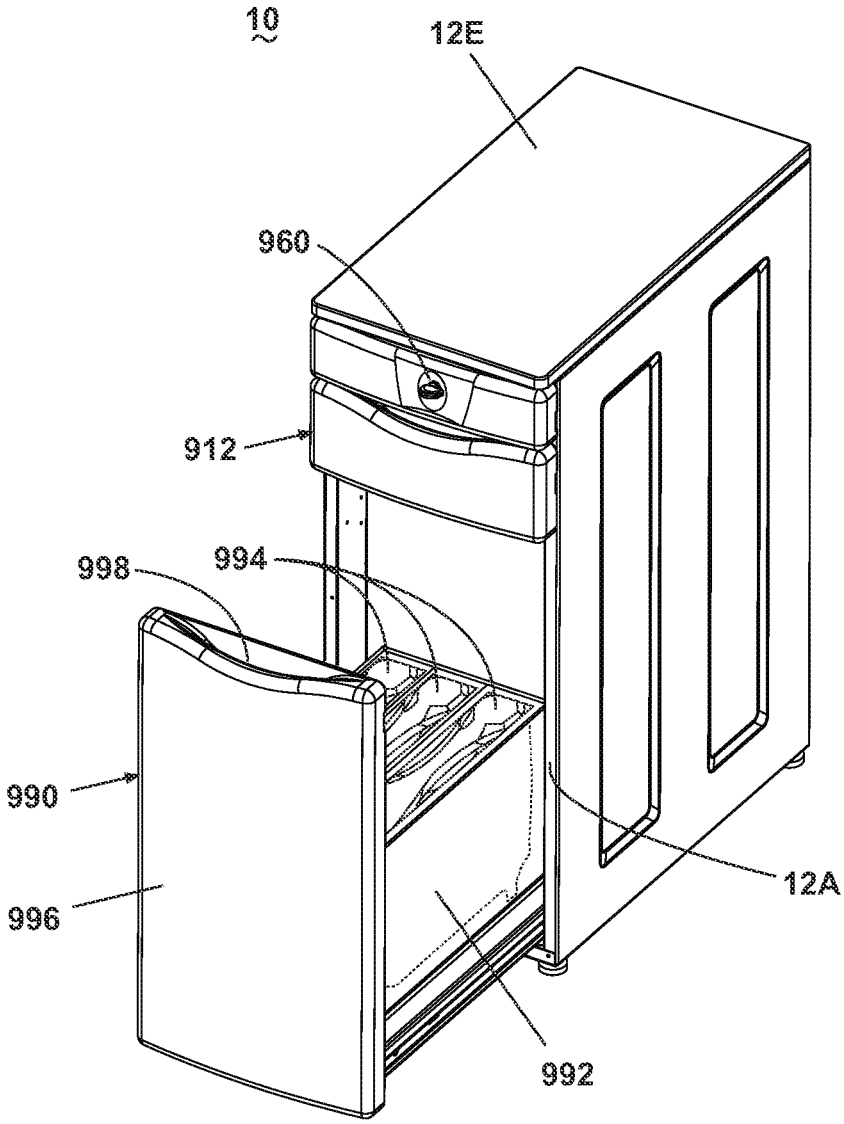
FIG. 12 is a perspective view of a ninth embodiment of the vertical laundry module comprising a bulk dispensing function.

The combination of two non-laundry care functions can comprise a storage function and a bulk dispensing function. Referring to FIG. 12, a ninth embodiment of the invention is shown wherein the vertical laundry module 10 has approximately the same height as the associated laundry appliance 20, as described previously, and comprises a drawer 912 that defines an interior storage space and a bulk dispensing drawer 990. The drawer 912 and bulk dispensing drawer 990 are mounted to slidably open from the front face 12*a* of the vertical laundry module 10.

The bulk dispensing drawer 990 comprises a drawer body 992 having a front panel 996 joined to the front wall of the drawer body 992 using any suitable fastening means and a handle 998 integrally formed along the top edge of the front panel 996 of the bulk dispensing drawer 990 to enable the user to pull the bulk dispensing drawer 990 from the vertical laundry module 10. The bulk dispensing drawer 990 can house, at least partially, a bulk dispensing assembly comprising one or more refillable containers 994 that store a supply of a laundry aid and are fluidly connected to a dispensing apparatus (not shown) that discharges a predetermined amount of laundry aid upon request from the laundry appliance 20. The bulk dispensing assembly can also be controlled by a control panel 960 located on the vertical laundry module 10. An example of a suitable bulk dispensing apparatus is described in German Patent No. 8033429, published May 19, 1982, which is incorporated herein by reference in its entirety.

The ninth embodiment of the vertical laundry module 10 could also comprise the backsplash, in which case the vertical laundry module 10 would have approximately the same depth as the associated laundry appliance 20, in addition to having approximately the same height.

Other combinations of non-laundry care and laundry care functions not specifically shown in the drawings are possible. Additionally, any of these combinations can include a backsplash.

In the above embodiments, the drawers are opened by the handles. As an alternative, the drawers can be fitted with an automated opening capability. The mechanism can, for example, be operated through a push-push mechanism by pushing the front of the drawers, or by a control panel on a face or backsplash of the vertical laundry module 10. The drawer could also be opened by hands-free operation such as a foot actuated pedal or a kickspace formed near the bottom end of the vertical laundry module 10.

The laundry system can also be adapted to prevent transference of vibration between the laundry appliance 20 and the vertical laundry module 10. Consequently, vibration caused by operation of one of the vertical laundry module 10 and/or of the laundry appliance 20 does not transfer to other vertical laundry modules 10 and laundry appliances 20 in the laundry system. Thus, the other vertical laundry modules 10 and laundry appliances 20 remain relatively stationary, and any items supported by the vertical laundry module 10 and the laundry appliances 20 will not shake or fall from the respective vertical laundry module 10 and the laundry appliances 20. The laundry system can incorporate any suitable means for damping vibration or preventing transference of vibration. For example, vibration dampening or isolation pads can be positioned between adjacent components of the modular laundry system. The isolation pads can be made of a material, such as rubber, that dampens vibrations.

In addition to having aesthetically matching backsplashes 30, 24, the vertical laundry module 10 and the laundry appliance 20 can have matching designs to create a laundry system with an aesthetically coherent appearance. The outer surfaces of the vertical laundry module 10 can have the same design as the laundry appliance 20 such that the outer surface of the laundry module 10 is the same material, texture, and color as the outer surface of the laundry appliance 20. This can be accomplished by having a module frame and interchangeable parts, including panels, drawers, doors, backsplashes, etc., made to match known models of laundry appliances 20. When the vertical laundry module 10 and the laundry appliance 20 match one another, not only does the laundry system provide an aesthetically pleasing appearance, but a consumer is more likely to purchase multiple laundry system items to create a coherent appearance in the laundry area rather than purchasing a hodgepodge of gadgets to fulfill their laundry care and non-laundry care functional needs in the laundry area. Various items can be added to the vertical laundry module 10 and the laundry appliance 20 to contribute to the aesthetically coherent appearance. For example, mats, similar to the mat 490 shown in FIG. 7, having a matching color/pattern and/or texture can be placed on top of the vertical laundry module 10 and the laundry appliance 20. The mats can cover one or more of the vertical laundry module 10 and/or laundry appliance 20.

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular laundry system comprising:

a first laundry appliance comprising a housing having a width, an upper surface and defining an interior, and configured to at least one of wash and dry fabric items;

a second laundry appliance comprising a housing having a width, an upper surface and defining an interior, and configured to at least one of wash and dry fabric items; and a vertical laundry module comprising:

a housing defining an interior and having a front face, an upper surface, and a width less than the width of each of the first and second laundry appliances;

multiple shelves located in the interior of the housing;

a door opening from the front face of the housing of the vertical laundry module to access the interior and to the multiple shelves; and one or more functional elements located exteriorly of the housing, wherein at least one of the one or more functional elements comprises a hanging element overlying the upper surface of the housing of the vertical laundry module;

wherein the first laundry appliance, the second laundry appliance, and the vertical laundry module are of the same height such that the upper surfaces are co-planar and form an effective continuous upper surface; and wherein the first laundry appliance, the second laundry appliance, and the vertical laundry module are stand-alone units arranged in a contiguous relationship to form a coherent modular system.

2. The modular laundry system according to claim 1, wherein the hanging element comprises a hanging rod.

3. The modular laundry system according to claim 2, wherein the hanging rod is extendable from and retractable into the housing of the vertical laundry module.

4. The modular laundry system according to claim 1, wherein the hanging element comprises a post extending from the upper surface a top face of the housing and a hanging bar mounted to the post.

5. The modular laundry system according to claim 4, wherein the length of the post is adjustable to select the height of the bar relative to the upper surface.

6. The modular laundry system according to claim 1, wherein the vertical laundry module comprises multiple functional elements.

7. The modular laundry system according to claim 6, wherein the multiple functional elements comprise a first functional element that performs a first function and a second functional element that performs a second function different than the first function.

8. The modular laundry system according to claim 1, wherein the vertical laundry module further comprises a backsplash coupled to the housing and extending above the upper surface.

9. The modular laundry system according to claim 8, wherein the backsplash is complementary with backsplashes of the first and second laundry appliances.

10. The modular laundry system according to claim 8, wherein the backsplash comprises a functional element.

11. The modular laundry system according to claim 1, wherein one or more additional functional elements are located interiorly of the housing and the door provides access to the one or more functional elements.

12. The modular laundry system according to claim 11, wherein the one or more additional functional elements located interiorly of the housing performs a non-laundry care function selected from a group comprising at least one of a storage, staging, garbage and recycling collection, shelving, laundry sorting, hanging, bulk dispensing, resource management, resource supply and/or recovery/reclamation, resource treatment, lighting, refrigeration, entertainment, pet care, data collection and communication, home automation, home security, home safety, power outlet and supply, and module controller function.

13. The modular laundry system according to claim 11, wherein the one or more additional functional elements located interiorly of the housing comprises at least one of a compartmentalized tray, a hanging rod, a peg board, and a bulk dispensing assembly.

14. The modular laundry system according to claim 11, wherein one or more additional functional elements located interiorly of the housing performs a laundry care function selected from a group comprising at least one of a washing, drying, refreshing, sanitizing, sink, ironing, steaming, and stain treatment function.

15. The modular laundry system according to claim 1, wherein all of the upper surfaces are at the same height to form a coherent modular system having an effective continuous upper surface.

16. The modular laundry system according to claim 1, wherein the first and second laundry appliances are selected from a group comprising a washing machine, a non-aqueous washing apparatus, a tumble dryer, a combination washing machine and dryer, a tumbling refreshing machine, and an extractor.

17. The modular laundry system according to claim 16, wherein the first laundry appliance is a washing machine, and the second laundry appliance is a dryer.

* * * * *